US009282799B2

(12) United States Patent
Courtney et al.

(10) Patent No.: US 9,282,799 B2
(45) **Date of Patent: *Mar. 15, 2016**

(54) ATTACHMENT FOR A HAND HELD APPLIANCE

(71) Applicant: Dyson Technology Limited, Wiltshire (GB)

(72) Inventors: Stephen Benjamin Courtney, Malmesbury (GB); Patrick Joseph William Moloney, Malmesbury (GB); Edward Shelton, Malmesbury (GB); Thomas James Dunning Follows, Malmesbury (GB); David Michael Jones, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 180 days.

This patent is subject to a terminal disclaimer.

(21) Appl. No.: 13/935,146

(22) Filed: Jul. 3, 2013

(65) Prior Publication Data

US 2014/0007449 A1 Jan. 9, 2014

(30) Foreign Application Priority Data

Jul. 4, 2012 (GB) ..... 1211837.8

(51) Int. Cl.
*A45D 20/00* (2006.01)
*A45D 20/12* (2006.01)

(52) U.S. Cl.
CPC ..... *A45D 20/00* (2013.01); *A45D 20/12* (2013.01); *A45D 20/122* (2013.01); *A45D 20/124* (2013.01)

(58) Field of Classification Search
CPC ..... A46B 11/00; A46B 11/06; A45D 20/00
USPC ..... 34/96, 97, 98, 99, 100; 392/384, 385; D28/13
See application file for complete search history.

(56) References Cited

U.S. PATENT DOCUMENTS 3,265,075 A 8/1966 Edman et al.
4,250,902 A 2/1981 Ihara
(Continued)

FOREIGN PATENT DOCUMENTS

CH 588 835 6/1977
CN 200973446 11/2007
(Continued)

OTHER PUBLICATIONS

Search Report dated Oct. 1, 2012, directed to GB Application No. 1211837.8; 1 page.
(Continued)

*Primary Examiner* — Stephen M Gravini
(74) *Attorney, Agent, or Firm* — Morrison & Foerster LLP

(57) ABSTRACT

A hairdryer includes a handle; a body comprising a fluid outlet and a primary fluid outlet; a fan unit for generating fluid flow through the hairdryer, the hairdryer comprising a fluid flow path extending from a fluid inlet through which a fluid flow enters the hairdryer to the fluid outlet, and a primary fluid flow path extending from a primary fluid inlet to the primary fluid outlet; a heater for heating the primary fluid flow drawn through the primary fluid inlet; and a nozzle attachable to the body, the nozzle comprising a nozzle fluid inlet for receiving the primary fluid flow from the primary fluid outlet, and a nozzle fluid outlet for emitting the primary fluid flow, and wherein the nozzle is configured to inhibit the emission of the fluid flow from the fluid outlet.

20 Claims, 21 Drawing Sheets

(56) References Cited

U.S. PATENT DOCUMENTS

| | | | | |
|---|---|---|---|---|
| 4,350,872 | A | 9/1982 | Meywald et al. | |
| 4,596,921 | A | 6/1986 | Hersh et al. | |
| 4,767,914 | A | 8/1988 | Glucksman | |
| 5,133,043 | A | 7/1992 | Baugh | |
| D350,413 | S | 9/1994 | Feil | |
| D352,365 | S | 11/1994 | Hansen et al. | |
| 5,378,882 | A | 1/1995 | Gong et al. | |
| 5,546,674 | A | 8/1996 | Lange et al. | |
| 5,572,800 | A | 11/1996 | West | |
| 5,598,640 | A | 2/1997 | Schepisi | |
| 5,681,630 | A | 10/1997 | Smick et al. | |
| 5,875,562 | A | 3/1999 | Fogarty | |
| 6,203,349 | B1 | 3/2001 | Nakazawa | |
| 6,751,886 | B2 | 6/2004 | Chang et al. | |
| 6,889,445 | B1 | 5/2005 | Varona et al. | |
| D550,813 | S | 9/2007 | Lammel et al. | |
| 7,412,781 | B2 * | 8/2008 | Mattinger et al. | 34/96 |
| D646,354 | S | 10/2011 | Gessi | |
| 8,082,679 | B1 * | 12/2011 | Arnim | 34/97 |
| 8,132,571 | B1 | 3/2012 | Jackson | |
| D696,386 | S | 12/2013 | Schoenherr et al. | |
| D702,322 | S | 4/2014 | Sieger | |
| 2004/0163274 | A1 | 8/2004 | Andrew et al. | |
| 2004/0172847 | A1 | 9/2004 | Saida et al. | |
| 2005/0072019 | A1 * | 4/2005 | Rago et al. | 34/96 |
| 2005/0229422 | A1 | 10/2005 | Mattinger et al. | |
| 2006/0075654 | A1 | 4/2006 | Lin | |
| 2007/0294909 | A1 | 12/2007 | Abdi et al. | |
| 2010/0064542 | A1 | 3/2010 | Mulvaney et al. | |
| 2010/0065545 | A1 | 3/2010 | Chung et al. | |
| 2011/0079239 | A1 | 4/2011 | Hall | |
| 2011/0177711 | A1 | 7/2011 | Park | |
| 2011/0203128 | A1 | 8/2011 | Rodrigues | |
| 2011/0219636 | A1 | 9/2011 | Rowling | |
| 2013/0111777 | A1 | 5/2013 | Jeong | |
| 2013/0269200 | A1 | 10/2013 | Moloney et al. | |
| 2013/0269201 | A1 | 10/2013 | Courtney et al. | |
| 2013/0276320 | A1 | 10/2013 | Courtney et al. | |
| 2013/0276321 | A1 | 10/2013 | Courtney et al. | |
| 2013/0283630 | A1 | 10/2013 | Courtney et al. | |
| 2013/0283631 | A1 | 10/2013 | Moloney et al. | |
| 2014/0007448 | A1 | 1/2014 | Courtney et al. | |
| 2014/0007449 | A1 * | 1/2014 | Courtney et al. | 34/97 |
| 2015/0007854 | A1 | 1/2015 | Moloney et al. | |
| 2015/0007855 | A1 | 1/2015 | Moloney et al. | |

FOREIGN PATENT DOCUMENTS

| | | | | |
|---|---|---|---|---|
| CN | 201328477 | | 10/2009 | |
| CN | 201328477 | Y | 10/2009 | |
| CN | 201341553 | | 11/2009 | |
| CN | 101292806 | | 10/2010 | |
| CN | 201774080 | | 3/2011 | |
| CN | 201948229 | | 8/2011 | |
| CN | 202146022 | | 2/2012 | |
| CN | 202536440 | | 11/2012 | |
| CN | 202774786 | | 3/2013 | |
| DE | 26 18 819 | | 11/1977 | |
| DE | 4227829 | A1 * | 6/1993 | A45D 20/10 |
| DE | 195 27 111 | | 1/1997 | |
| DE | 10 2009 049 | | 4/2011 | |
| EP | 0 105 810 | | 4/1984 | |
| EP | 0 300 281 | | 1/1989 | |
| EP | 0 306 765 | | 3/1989 | |
| EP | 0 970 633 | | 1/2000 | |
| EP | 1 433 401 | | 8/2004 | |
| EP | 1 616 500 | | 1/2006 | |
| EP | 2 000 042 | | 12/2008 | |
| EP | 2 255 692 | | 12/2010 | |
| EP | 2 392 223 | | 12/2011 | |
| EP | 2 401 939 | | 1/2012 | |
| FR | 1387334 | | 1/1965 | |
| FR | 1408096 | | 8/1965 | |
| GB | 647291 | | 12/1950 | |
| GB | 953057 | | 3/1964 | |
| GB | 1 446 385 | | 8/1976 | |
| GB | 1 456 000 | | 11/1976 | |
| GB | 1475788 | A * | 6/1977 | |
| GB | 1 489 723 | | 10/1977 | |
| GB | 1 539 485 | | 1/1979 | |
| GB | 2 295 056 | | 5/1996 | |
| GB | 2 316 868 | | 3/1998 | |
| GB | 2472240 | | 2/2011 | |
| GB | 2478927 | | 9/2011 | |
| GB | 2482547 | | 2/2012 | |
| GB | 2482548 | | 2/2012 | |
| GB | 2482549 | | 2/2012 | |
| GB | 2500798 | | 10/2013 | |
| GB | 2500800 | | 10/2013 | |
| GB | 2503684 | | 1/2014 | |
| GB | 2503685 | | 1/2014 | |
| GB | 2503686 | | 1/2014 | |
| JP | 53-106181 | | 8/1978 | |
| JP | 60-135700 | | 7/1985 | |
| JP | 1-27506 | | 1/1989 | |
| JP | 1-29208 | | 1/1989 | |
| JP | 4-221507 | | 8/1992 | |
| JP | 5-7507 | | 1/1993 | |
| JP | 5-130915 | | 5/1993 | |
| JP | 06-327514 | | 11/1994 | |
| JP | 7-16113 | | 1/1995 | |
| JP | 7-155219 | | 6/1995 | |
| JP | 8-343 | | 1/1996 | |
| JP | 2000-201723 | | 7/2000 | |
| JP | 2001-37530 | | 2/2001 | |
| JP | 2001-78825 | | 3/2001 | |
| JP | 2002-238649 | | 8/2002 | |
| JP | 2003-153731 | | 5/2003 | |
| JP | 2004-312 | | 1/2004 | |
| JP | 2004-113402 | | 4/2004 | |
| JP | 2004-208935 | | 7/2004 | |
| JP | 2004-293389 | | 10/2004 | |
| JP | 2004-357763 | | 12/2004 | |
| JP | 2005-546 | | 1/2005 | |
| JP | 2005-532131 | | 10/2005 | |
| JP | 2006-51181 | | 2/2006 | |
| JP | 2006-130181 | | 5/2006 | |
| JP | 2006-181265 | | 7/2006 | |
| JP | 2007-136121 | | 6/2007 | |
| JP | 2010-274050 | | 12/2010 | |
| JP | 2011-56141 | | 3/2011 | |
| JP | 2012019866 | A * | 2/2012 | |
| JP | 2012-45178 | | 3/2012 | |
| TW | 257676 | | 3/2005 | |
| TW | 201206368 | | 2/2012 | |
| WO | WO-83/02753 | | 8/1983 | |
| WO | WO-94/23611 | | 10/1994 | |
| WO | WO-2004/006712 | | 1/2004 | |
| WO | WO-2005/120283 | | 12/2005 | |
| WO | WO-2007/043732 | | 4/2007 | |
| WO | WO-2008/053099 | | 5/2008 | |
| WO | WO-2012/059700 | | 5/2012 | |
| WO | WO-2012/069983 | | 5/2012 | |
| WO | WO-2012/076885 | | 6/2012 | |

OTHER PUBLICATIONS

Reba, I. (1966). "Applications of the Coanda Effect," Scientific American 214:84-92.

International Search Report and Written Opinion mailed Sep. 30, 2013, directed to International Application No. PCT/GB2013/051538; 8 pages.

Courtney et al., U.S. Office Action mailed Sep. 2, 2015, directed to U.S. Appl. No. 13/934,692; 11 pages.

* cited by examiner

ATTACHMENT FOR A HAND HELD APPLIANCE

REFERENCE TO RELATED APPLICATIONS

This application claims the priority of United Kingdom Application No. 1211837.8, filed Jul. 4, 2012, the entire contents of which are incorporated herein by reference.

FIELD OF THE INVENTION

This invention relates to an attachment for a hand held appliance, in particular an attachment for a hairdryer and an appliance, particularly a hairdryer comprising such an attachment.

BACKGROUND OF THE INVENTION

Blowers and in particular hot air blowers are used for a variety of applications such as drying substances such as paint or hair and cleaning or stripping surface layers. Generally, a motor and fan are provided which draw fluid into a body; the fluid may be heated prior to exiting the body. The motor is susceptible to damage from foreign objects such as dirt or hair so conventionally a filter is provided at the fluid intake end of the blower. Conventionally such appliances are provided with a nozzle which can be attached and detached from the appliance and changes the shape and velocity of fluid flow that exits the appliance. Such nozzles can be used to focus the outflow of the appliance or to diffuse the outflow depending on the requirements of the user at that time.

SUMMARY OF THE INVENTION

According to a first aspect, the invention provides a hairdryer comprising a handle, a body comprising a fluid outlet and a primary fluid outlet, a fan unit for generating fluid flow through the hairdryer, the hairdryer comprising a fluid flow path extending from a fluid inlet through which a fluid flow enters the hairdryer to the fluid outlet, and a primary fluid flow path extending from a primary fluid inlet to the primary fluid outlet, a heater for heating the primary fluid flow drawn through the primary fluid inlet, and a nozzle attachable to the body, the nozzle comprising a nozzle fluid inlet for receiving the primary fluid flow from the primary fluid outlet, and a nozzle fluid outlet for emitting the primary fluid flow, and wherein the nozzle is configured to inhibit the emission of the fluid flow from the fluid outlet.

The hairdryer has a primary flow which is that processed by and drawn into the appliance by the fan unit and a fluid flow which is entrained by the primary, processed flow. Thus the fluid flow through the hairdryer is amplified by the entrained flow.

The primary fluid flow path starts at a primary fluid inlet into the hairdryer i.e. a primary fluid inlet through which a primary fluid flow enters the hairdryer.

Preferably, the nozzle is configured to inhibit the generation of the fluid flow.

It is preferred that the nozzle comprises means for inhibiting the flow of fluid along the fluid flow path to the fluid outlet.

Preferably, the means for inhibiting the flow of fluid along the flow path to the fluid outlet comprises a bather which is located within the fluid flow path when the nozzle is attached to the hairdryer.

It is preferred that the barrier is located at an end of the nozzle.

Preferably, the barrier is substantially orthogonal to the longitudinal axis of the nozzle. Alternatively, the barrier is inclined to the longitudinal axis of the nozzle.

It is preferred that the primary fluid outlet is configured to emit the primary fluid flow into the fluid flow path, and wherein the nozzle comprises a first end which is insertable into the fluid flow path through the fluid outlet, and a second end remote from the first end, and wherein the nozzle fluid inlet is located between the first end and the second end of the nozzle.

Preferably, wherein the nozzle fluid inlet comprises at least one aperture extending at least partially about the longitudinal axis of the nozzle. It is preferred that the nozzle fluid inlet comprises a plurality of apertures extending circumferentially about the longitudinal axis of the nozzle.

Preferably, the at least one aperture has a length extending in the direction of the longitudinal axis of the nozzle, and wherein the length of said at least one aperture varies about the longitudinal axis of the nozzle.

It is preferred that the nozzle comprises a side wall between the first end and the second end of the nozzle, and wherein a portion of the side wall which is located between the first end and the second end of the nozzle at least partially defines the nozzle fluid inlet.

Preferably, the side wall is tubular in shape. It is preferred that the nozzle fluid inlet is formed in the side wall.

Preferably, the side wall extends about an inner wall, and wherein the nozzle fluid inlet is located between the walls of the nozzle. It is preferred that the inner wall is tubular in shape.

Preferably, the inner wall extends from the first end to the second end. It is preferred that the second end of the nozzle comprises the nozzle fluid outlet.

It is preferred that the nozzle fluid outlet is located between the first end and the second end of the nozzle.

According to a second aspect, the invention provides a nozzle for a hairdryer comprising a handle, a body comprising a fluid outlet and a primary fluid outlet, a fan unit for generating fluid flow through the hairdryer, a fluid flow path extending from a fluid inlet through which a fluid flow enters the hairdryer to the fluid outlet, and a primary fluid flow path extending from a primary fluid inlet to the primary fluid outlet, and a heater for heating the primary fluid flow drawn through the primary fluid inlet, wherein the nozzle is attachable to the body, the nozzle comprising a nozzle fluid inlet for receiving the primary fluid flow from the primary fluid outlet, and a nozzle fluid outlet for emitting the primary fluid flow, and wherein the nozzle is configured to inhibit the emission of the fluid flow from the fluid outlet.

The primary fluid flow path starts at a primary fluid inlet into the hairdryer, i.e. a primary fluid inlet through which a primary fluid flow enters the hairdryer.

Preferably, the nozzle is configured to inhibit the generation of the fluid flow.

It is preferred that the nozzle comprises means for inhibiting the flow of fluid along the fluid flow path to the fluid outlet of the hairdryer.

Preferably, the means for inhibiting the flow of fluid along the flow path to the fluid outlet comprises a bather which is located within the fluid flow path when the nozzle is attached to the hairdryer.

It is preferred that the barrier is located at an end of the nozzle.

Preferably, the barrier is substantially orthogonal to the longitudinal axis of the nozzle.

Alternatively, the barrier is inclined to the longitudinal axis of the nozzle.

Preferably, the nozzle comprises a first end which is insertable into the fluid flow path through the fluid outlet, and a second end remote from the first end, and wherein the nozzle fluid inlet is located between the first end and the second end of the nozzle.

It is preferred that the nozzle fluid inlet comprises at least one aperture extending at least partially about the longitudinal axis of the nozzle.

Preferably, the nozzle fluid inlet comprises a plurality of apertures extending circumferentially about the longitudinal axis of the nozzle.

It is preferred that the at least one aperture has a length extending in the direction of the longitudinal axis of the nozzle, and wherein the length of said at least one aperture varies about the longitudinal axis of the nozzle.

Preferably, the nozzle comprises a side wall between the first end and the second end of the nozzle, and wherein a portion of the side wall which is located between the first end and the second end of the nozzle at least partially defines the nozzle fluid inlet.

It is preferred that the side wall is tubular in shape.

Preferably, the nozzle fluid inlet is formed in the side wall.

It is preferred that the side wall extends about an inner wall, and wherein the nozzle fluid inlet is located between the walls of the nozzle.

Preferably, the inner wall is tubular in shape. It is preferred that the inner wall extends from the first end to the second end.

It is preferred that the second end of the nozzle comprises the nozzle fluid outlet.

Preferably, the nozzle fluid outlet is located between the first end and the second end of the nozzle.

BRIEF DESCRIPTION OF THE DRAWINGS

The invention will now be described by way of example and with reference to the accompanying drawings, of which.

DETAILED DESCRIPTION OF THE INVENTION

Figure 1A:
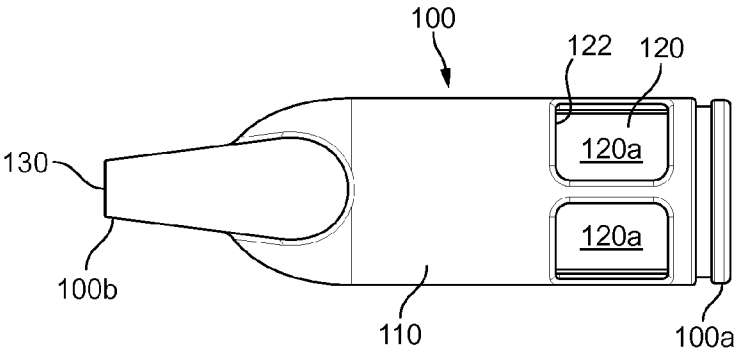
FIGS. 1*a* 1*f* show various representations of a single flow path nozzle according to the invention.
Figure 1B:
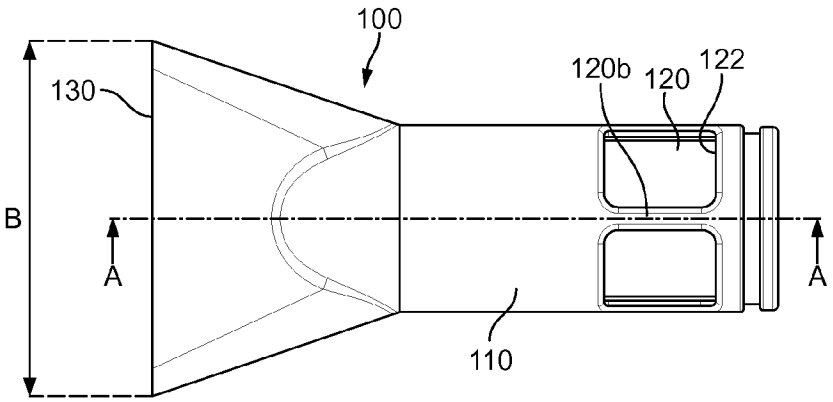
Figure 1E:
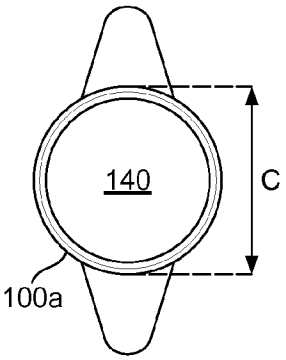
Figure 1D:
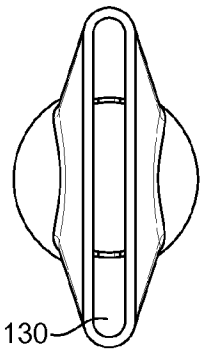
Figure 1C:
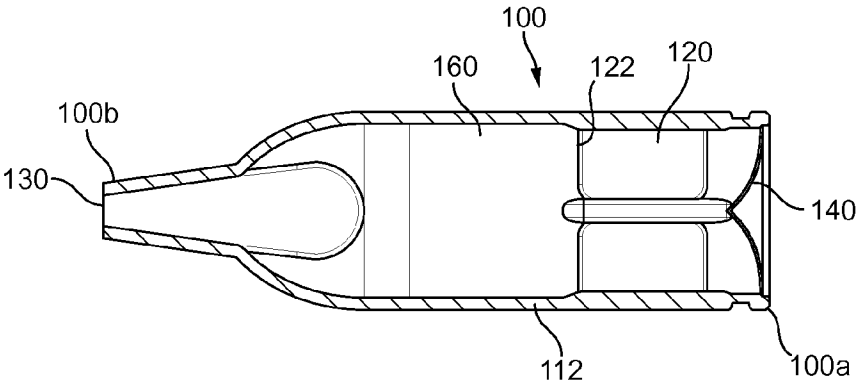
Figure 1F:
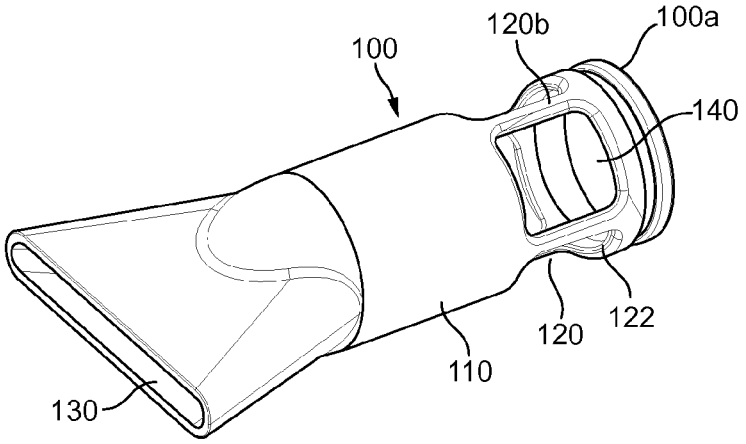

FIGS. 1*a* to 1*f* show a nozzle 100 comprising a generally tubular body 110 with a longitudinal axis A-A extending along the length of the body, having a fluid inlet 120 through a wall 112 of the body 110 and a fluid outlet 130 downstream of the fluid inlet 120. The fluid inlet 120 has a length that extends in the direction of the longitudinal axis A-A of the nozzle and is located between a first or upstream end 100*a* and a second or downstream end 100*b* of the nozzle 100.

In this example, the fluid outlet 130 is slot shaped and the length of the slot B-B is greater than the diameter C-C of the body 110. In this example, the fluid inlet 120 comprises a number of discrete apertures 120*a* separated by reinforcing struts 120*b*. The apertures 120*a* extend circumferentially about the longitudinal axis of the nozzle 100.

In use, fluid flows into the fluid inlet 120 along the length of the body 110 along fluid flow path 160 and out through the fluid outlet 130. The upstream end 100*a* of the nozzle 100 is closed by an end wall 140 thus fluid can only enter the nozzle 100 via the fluid inlet 120 when in use.

Figure 2A:
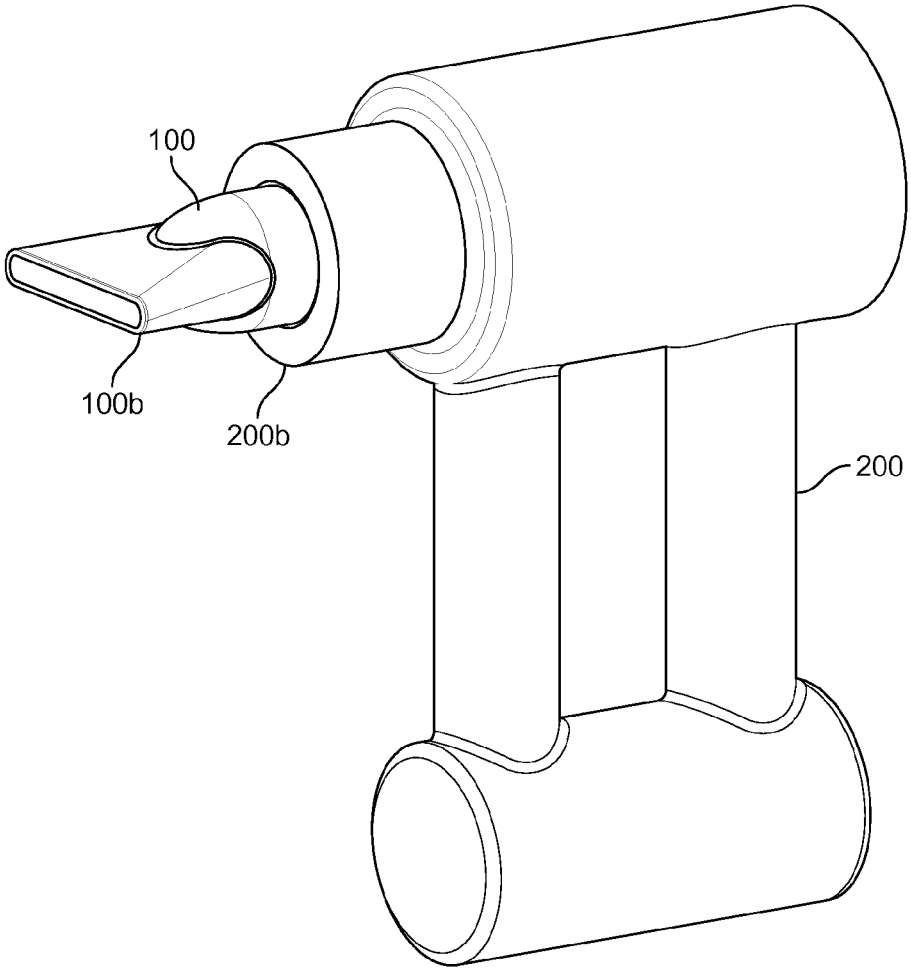
FIGS. 2*a* to 2*c* show various representations of a single flow path nozzle attached to a hairdryer.
Figure 2B:
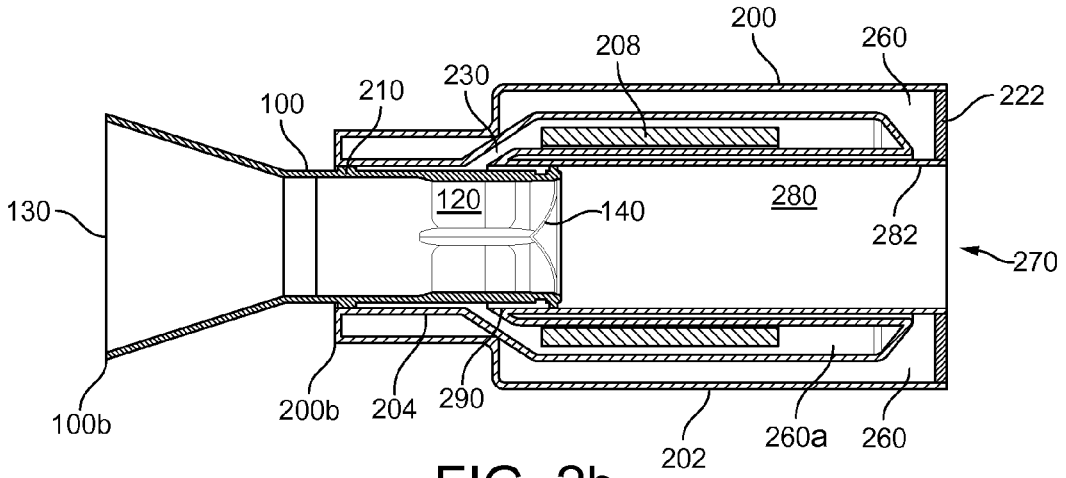
Figure 2C:
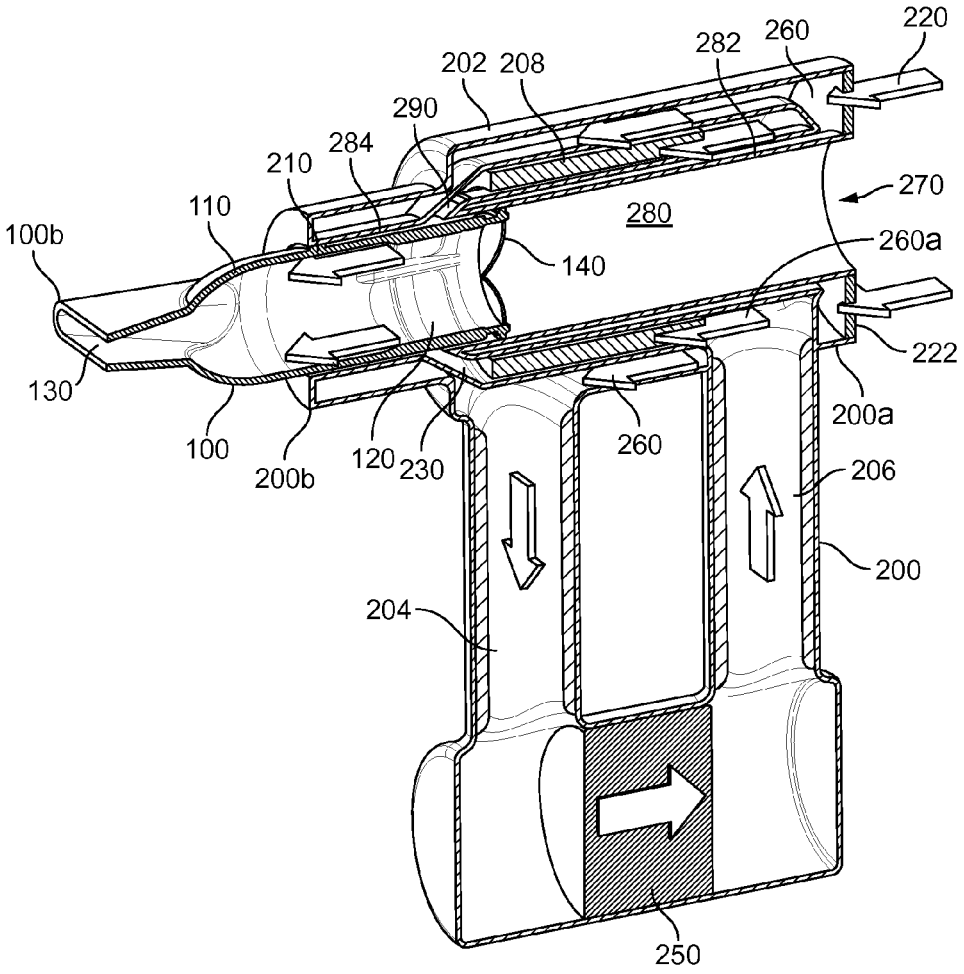

FIGS. 2*a* to 2*c* show the nozzle 100 attached to a hairdryer 200. The nozzle 100 is inserted into the downstream end 200*b* of the hairdryer until a stop 210 is reached. In this position, the fluid inlet 120 of the nozzle 100 is in fluid communication with a primary fluid outlet 230 of the hairdryer 200. The nozzle is an attachment for adjusting at least one parameter of the fluid flow emitted from the hairdryer and the downstream end 100*b* of the nozzle protrudes from the downstream end 200*b* of the hairdryer 200.

The hairdryer 200 has a handle 204, 206 and a body 202 which comprises a duct 282, 284. A primary fluid flow path 260 starts at a primary inlet 220 which in this example is located at the upstream end 200*a* of the hairdryer i.e. at the distal end of the hairdryer from the fluid outlet 200*b*. Fluid is drawn into the primary fluid inlet 220 by a fan unit 250, fluid flows along primary fluid flow path 260 located on the inside of the outer body 202 of the hairdryer between the outer body 202 and the duct 282, along a first handle portion 204 to the fan unit 250.

The fan unit 250 includes a fan and a motor. The fluid is drawn through the fan unit 250, along a second handle portion 206 and returns to the body 202 of the hairdryer in an inner tier 260*a* of the body. The inner tier 260*a* of the body 202 is nested within the primary fluid flow path 260 between the primary fluid flow path 260 and the duct 282 and includes a heater 208. The heater 208 is annular and heats the fluid that flows through the inner tier 260*a* directly. Downstream of the heater 208, fluid exits the primary fluid flow path at the primary outlet 230.

With the nozzle 100 attached to the hairdryer 200, the primary outlet 230 is in fluid communication with the fluid inlet 120 of the nozzle 100. Fluid that flows out of the primary outlet 230 flows along the body 110 of the nozzle 100 to the nozzle outlet 130.

The hairdryer 200 has a second fluid flow path 280. This second fluid flow path 280 flows from a second inlet 270 along the length of the body 202 of the hairdryer through duct 282 to a second outlet 290 outlet where, when there is no nozzle attached to the hairdryer, fluid flowing through the second fluid flow path 280 mixes with the primary fluid at the primary fluid outlet 230. This mixed flow continues along duct 284 to the fluid outlet 200*b* of the hairdryer. The fluid that flows through the second fluid flow path 280 is not processed by the fan unit 250; it is entrained by the primary fluid flow through the primary fluid flow path 260 when the fan unit is switched on.

The second fluid flow path 280 can be considered to flow along a tube defined by an upstream duct 282 and a downstream duct 284 where the primary outlet 230 is an aperture in the tube between the ducts 282 and 284. The nozzle is partially inserted into the tube defined by the ducts 284, 282. In this example the nozzle 100 is slidably inserted into hairdryer outlet 200*b* along downstream duct 284 past the aperture or primary fluid outlet 230 into the upstream duct 282. The nozzle 100 is retained in the duct 282, 284 by friction. In this example, the friction is provided between stop 210 and the duct 284 of the hairdryer.

Nozzle 100 is a single flow path nozzle and only fluid that has been processed by the fan unit 250 from the primary fluid flow path 260 flows through the nozzle 100. The end wall 140 of the nozzle 100 is a barrier that blocks the second fluid flow path 280 and thereby prevents entrainment into the second fluid flow path when the nozzle is properly attached to the hairdryer. The nozzle 100 prevents emission of the entrained fluid and inhibits the generation of the entrained fluid.

As an alternative, the nozzle could extend into downstream duct 284 of the hairdryer 200 but not as far as the primary fluid outlet 230. In this example, fluid from the primary fluid flow path 260 would mix with entrained fluid from the second fluid flow path 280 at the primary fluid outlet 230 and the mixed flow would enter the nozzle at the upstream end of the nozzle and continue to the fluid outlet 130 of the nozzle producing a combined fluid flow at the nozzle outlet.

It is advantageous that the end wall 140 of the nozzle 100 comprises a valve. This assists if the nozzle 100 is inserted into the hairdryer whilst the hairdryer is switch on. The valve is designed to open and let the full fluid flow through it this is for example around 22 l/s.

Figure 3A:
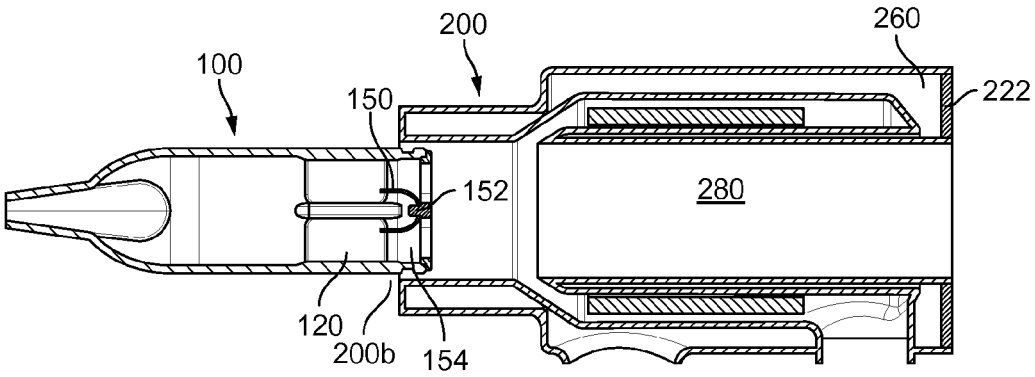
FIGS. 3*a* to 3*d* show a nozzle with an end valve.
Figure 3B:
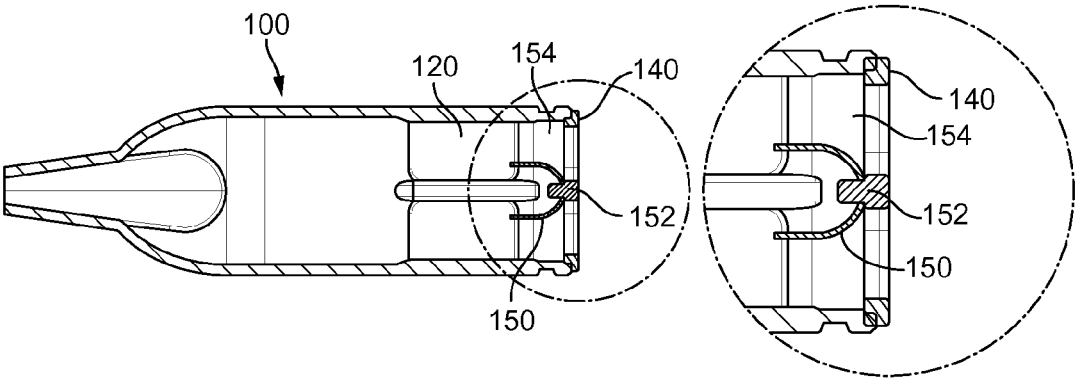

Referring now to FIGS. 3*a* to 3*d*, the operation of a valve in the nozzle will now be described. When the nozzle 100 is initially inserted into the outlet end 200*b* of a hairdryer 200 as is shown in FIG. 3*a*, the valve 150 in the upstream end wall 140 of the nozzle 100 opens. The valve 150 is attached to a central strut 152 of the end wall 140 and when the force of the fluid flow is high enough the valve 150 folds into the nozzle 100 to make an opening 154, for example an annular opening, in the end wall 140 of the nozzle 100. The valve 150 is pushed downstream by the force of the fluid flowing into the nozzle 100.

Figure 3C:
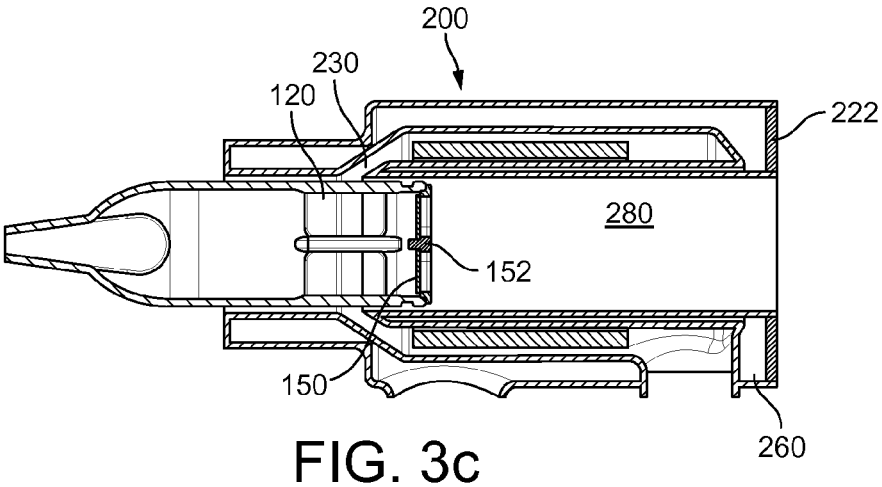
Figure 3D:
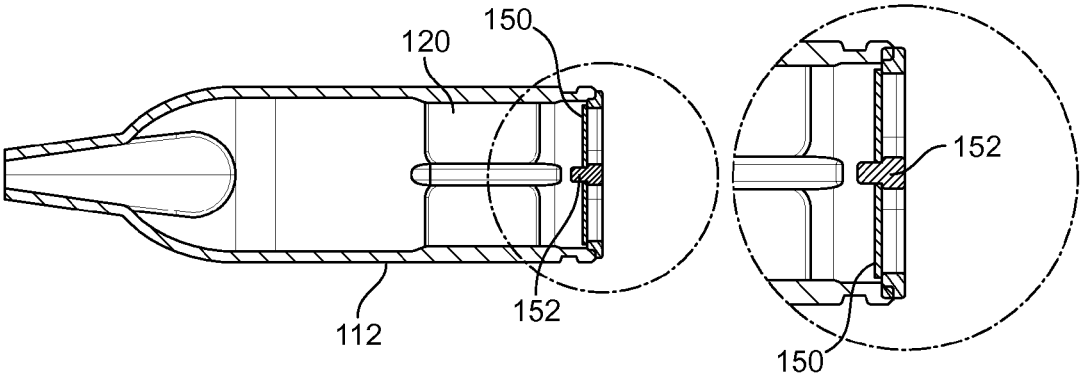

Once the inlet 120 is partially aligned with the primary outlet 230 of the hairdryer 200, some of the primary flow will flow through the inlet 120 which results in a reduction in the pressure at the valve 150. Once at least the majority of the primary flow goes through the inlet 120, the valve 150 will shut as is shown in FIG. 3*c*. When the valve 150 is shut the end wall 140 of the nozzle is blocked so fluid cannot flow through the second fluid flow path 280. Thus the only flow is from the primary outlet 230 of primary fluid flow path 260 into the inlet 120 of the nozzle.

Nozzle 100 is a hot styling nozzle. Although around only half of the normal flow through the hairdryer will flow through the nozzle to the outlet 130 the velocity of the flow is increased by the shape of the nozzle so a user will feel a similar force to that of normal flow. Normal flow is the total flow through the hairdryer without an attachment i.e. the primary flow plus the second or entrained flow. The shape of the nozzle outlet 130 reduces the cross sectional area compared with the hairdryer outlet 200*b* which increases the velocity of the flow.

Whilst the hairdryer shown has the primary fluid flow path flowing through the handles of the hairdryer, this is not required. The primary fluid flow path can alternatively flow from the primary inlet 220 along the body 202 through the heater to the primary fluid outlet 230 and thence into the nozzle.

FIGS. 6*a* to 6*f* show a nozzle 800 and a nozzle 800 attached to a hairdryer 200. In this embodiment, components illustrated and described with respect to FIGS. 2*a* to 2*c* have like reference numbers. The nozzle is similar to nozzle 100 but instead of a valve 150, this nozzle 800 is provided with a slanted upstream end 800*a* and fluid inlet 820 i.e. the fluid inlet 820 has a length that extends in the direction of the longitudinal axis of the nozzle 800 and varies about the longitudinal axis of the nozzle. The fluid inlet 820 is defined by a side wall 822 of the body 810 of the nozzle 800 where the side wall 822 is substantially orthogonal to the wall 812 of the body and the longitudinal axis A-A of the nozzle 800.

Figure 6A:
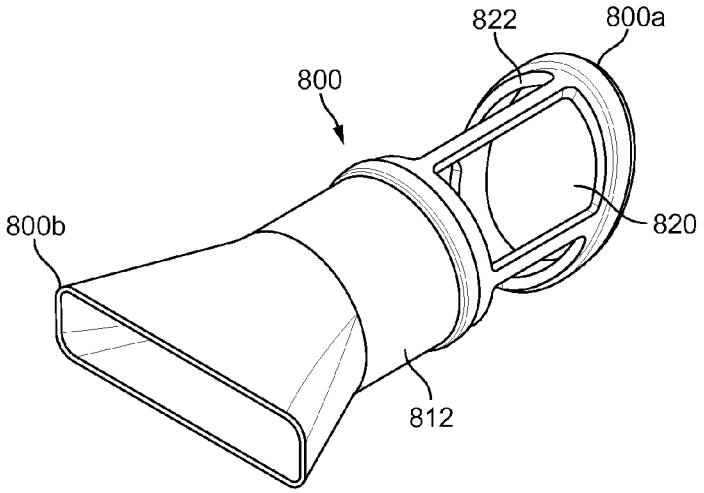
FIGS. 6*a* to 6*f* show another single flow path nozzle with a hairdryer.
Figure 6B:
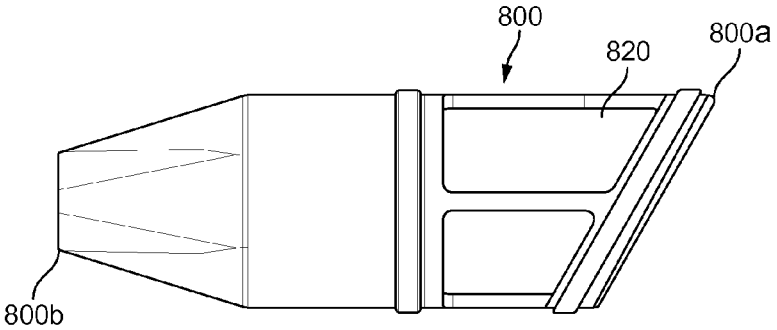
Figure 6C:
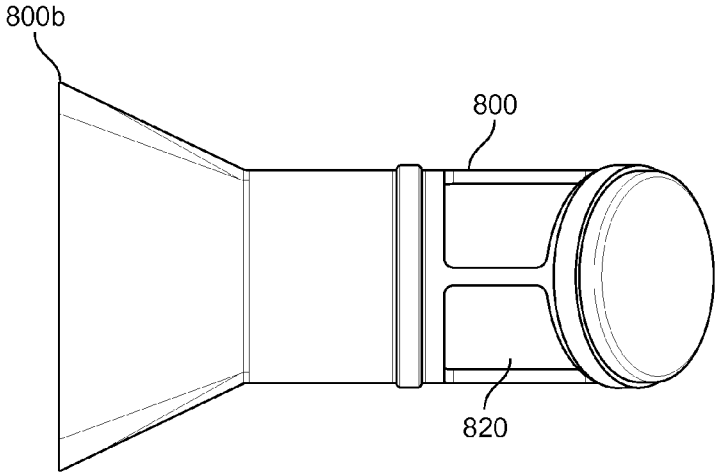
Figure 6D:
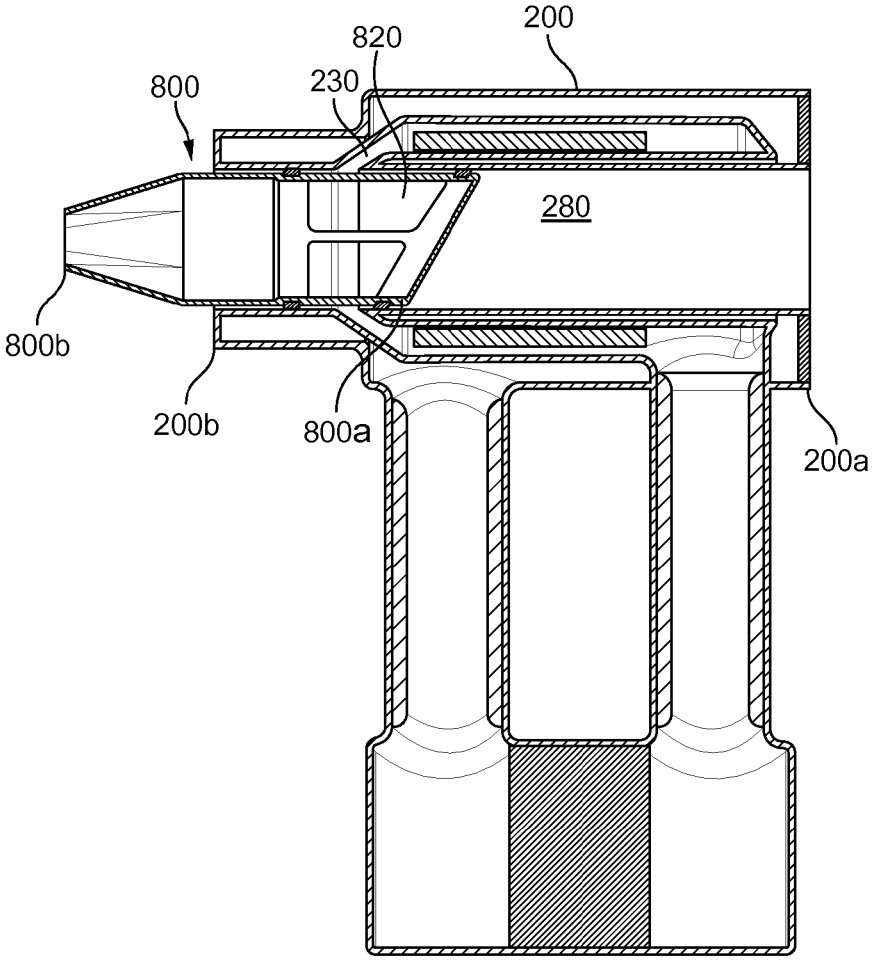
Figure 6E:
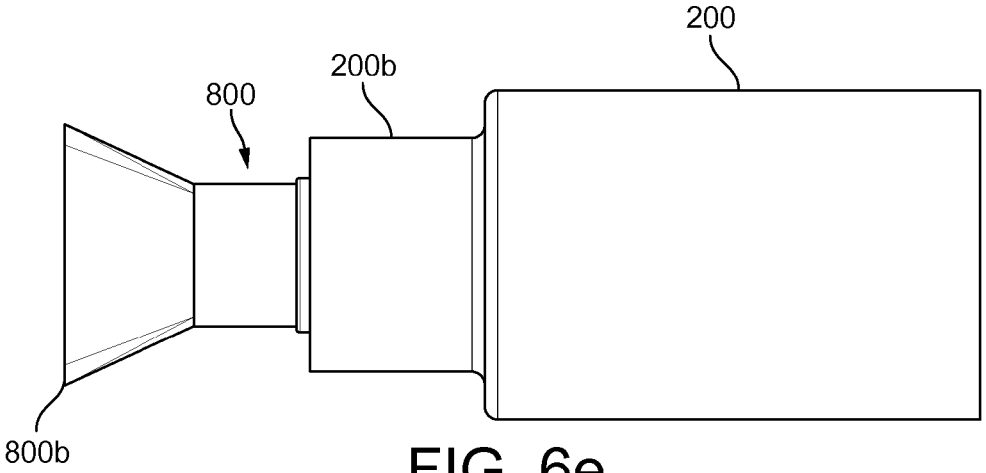
Figure 6F:
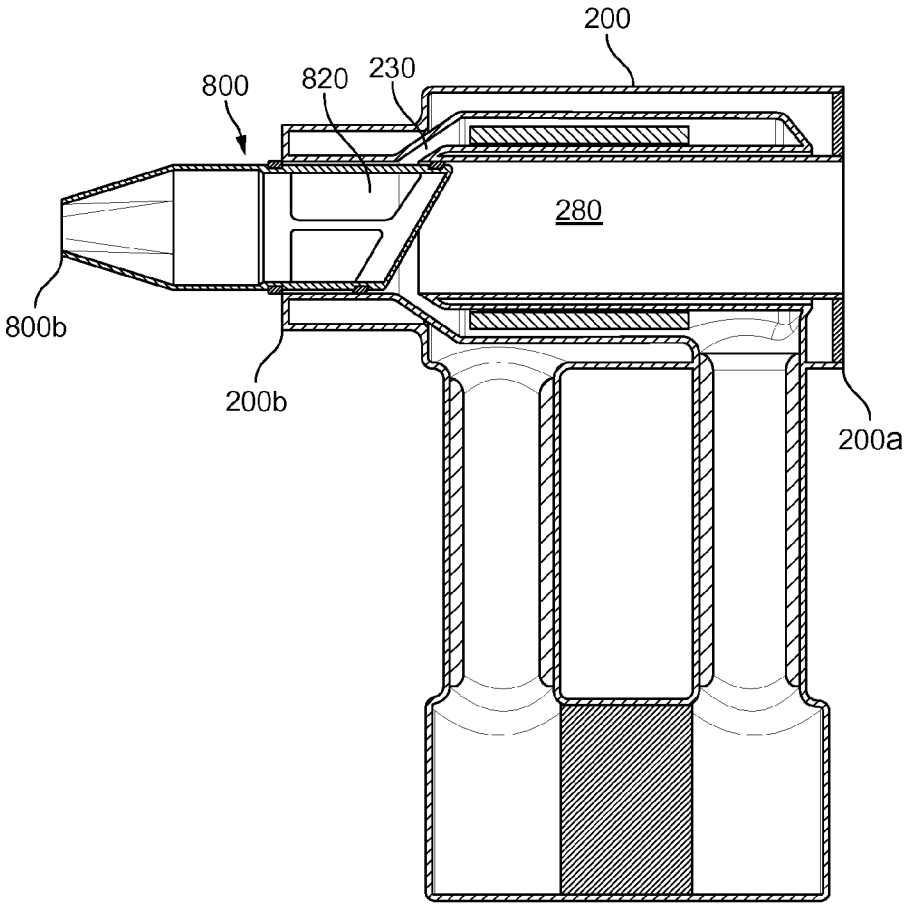

When the nozzle 800 is inserted into the outlet end 200*b* of a hairdryer 200, the fluid inlet 820 gradually aligns with the primary fluid outlet 230 of the hairdryer (FIG. 6*f*). When the nozzle 800 is fully inserted as is shown in FIG. 11*d*, the whole of the annular primary fluid outlet 230 is in fluid communication with the nozzle inlet 820.

There will be an initial resistance to the insertion of the nozzle 800 when the hairdryer is switched on as there will be both primary and second fluid flowing through the hairdryer however, the entrainment effect will gradually reduce as the hairdryer outlet end 200*b* is blocked by the slanted nozzle inlet end 800*a* until the hairdryer outlet end 800*b* is completely blocked. At this point, primary flow from the primary fluid outlet 230 that cannot enter the fluid inlet 820 is redirected down a second fluid flow path 280 towards the rear or upstream end 200*a* of the hairdryer. So, when the nozzle is initially inserted the primary flow cannot exit the downstream end 800*b* of the nozzle but can flow in a reverse direction along the second fluid flow path 280. This feature provides protection from the heater overheating during the nozzle insertion process as there will always be some fluid flowing through the primary fluid flow path.

FIGS. 4*a* to 4*g* show an alternate single flow path nozzle 600 having a generally tubular body 610, a first or upstream end 600*a* and a second or downstream end 600*b*. There is a fluid inlet 620 in an outer wall 612 of the body 610 between the first end 600*a* and the second end 600*b* of the nozzle 600 and a fluid outlet 630 downstream of the fluid inlet 620. In this example, the fluid outlet 630 is ring shaped or annular and is formed by an inner wall 614 of the nozzle 600 and the outer wall 612.

The fluid inlet 620 is an opening in the outer wall 612 of the nozzle and is defined by an aperture formed from a slanted edge 622*b* of the outer wall and a curved side wall 622 provided at the upstream end of the fluid inlet which connects the outer wall 612 and the inner wall 614. The slanted edge of the outer wall is slanted in the direction of fluid flow to reduce turbulence and pressure losses as the primary flow enters the nozzle.

The outer wall 612 surrounds inner wall 614 and together walls 612, 614 define a fluid flow path 660 through the generally tubular body 610 from the inlet 620 to the outlet 630. In the vicinity of the outlet 630, the inner wall curves outwards 614*b* and increases in diameter causing a reduction in the cross section of the fluid flow path at the outlet 630. The inner wall 614 continues beyond the outlet 630 and the end of the outer wall 612 of the nozzle 600 to a downstream nozzle end 600*b*. The inner wall 614*b* is convex and is a Coanda surface i.e. it causes fluid that flows through the fluid flow path 660 to hug the surface of the inner wall 614*b* as it curves forming an annular flow at the outlet 630 and downstream nozzle end 600*b*. In addition the Coanda surface 614 is arranged so a primary fluid flow exiting the outlet 630 is amplified by the Coanda effect.

The hairdryer achieves the output and cooling effect described above with a nozzle which includes a Coanda surface to provide an amplifying region utilising the Coanda effect. A Coanda surface is a known type of surface over which fluid flow exiting an output orifice close to the surface exhibits the Coanda effect. The fluid tends to flow over the surface closely, almost 'clinging to' or 'hugging' the surface.

The Coanda effect is already a proven, well documented method of entrainment whereby a primary air flow is directed over the Coanda surface. A description of the features of a Coanda surface, and the effect of fluid flow over a Coanda surface, can be found in articles such as Reba, Scientific American, Volume 214, June 1963 pages 84 to 92.

Advantageously, the assembly results in the entrainment of air surrounding the mouth of the nozzle such that the primary air flow is amplified by at least 15%, whilst a smooth overall output is maintained By encouraging the fluid at the outlet 630 to flow along 616 the curved surface 614*b* of the inner wall to the downstream nozzle end 600*b*, fluid is entrained 618 from outside the hairdryer 200 (FIG. 4*c*) by the Coanda effect. This action of entrainment increases the flow of air at the downstream nozzle end 600*b*, thus the volume of fluid flowing at the downstream nozzle end 600*b* is magnified by the entrainment above what is processed by the hairdryer 200 through a fan unit 250 and heater 208.

Figure 4A:
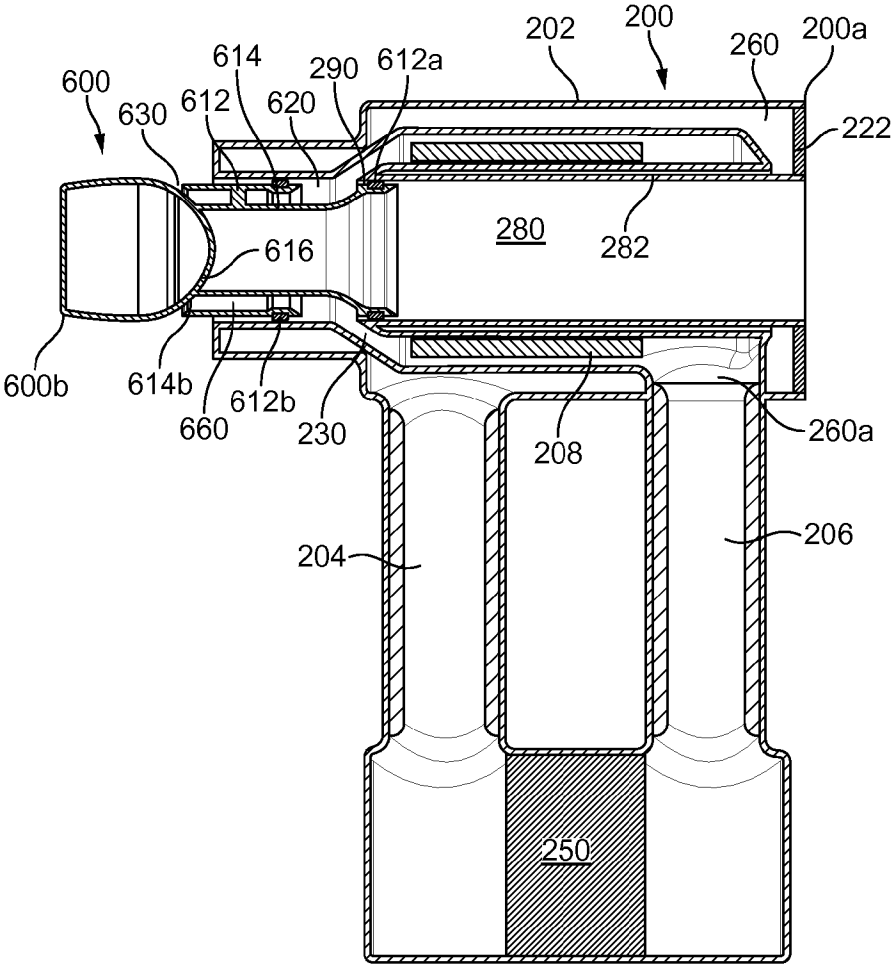
FIG. 4*a* shows an alternate single flow path nozzle attached to a hairdryer.
Figure 4B:
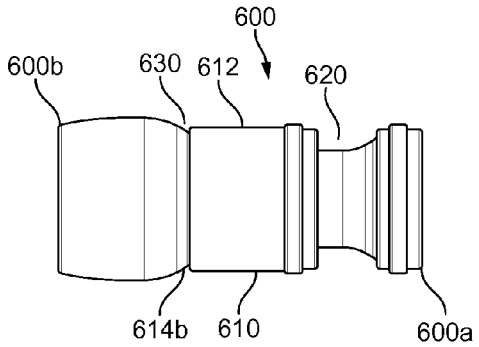
FIGS. 4*b* to 4*g* show an alternate single flow path nozzle.
Figure 4C:
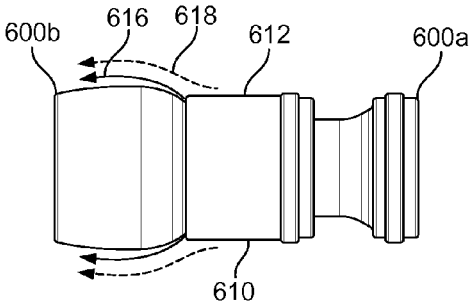
Figure 4D:
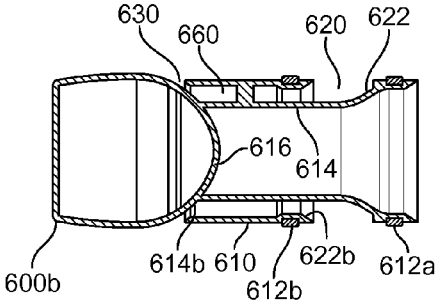
Figure 4E:
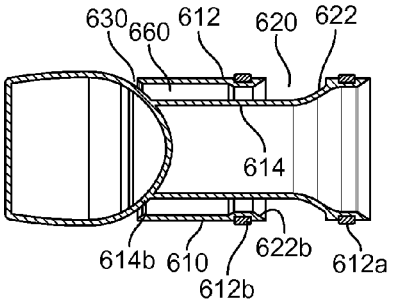
Figure 4F:
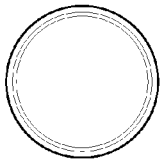
Figure 4G:
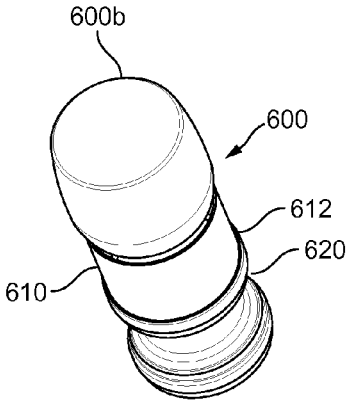
Figure 5A:
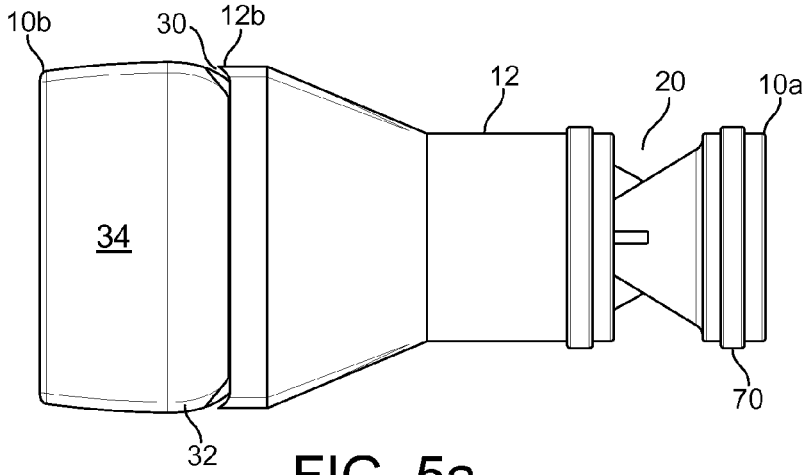
FIGS. 5*a* to 5*e* show a further single flow path nozzle.
Figure 5B:
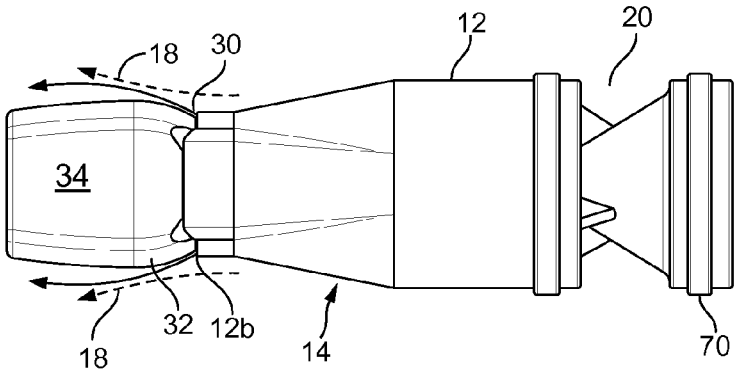
Figure 5C:
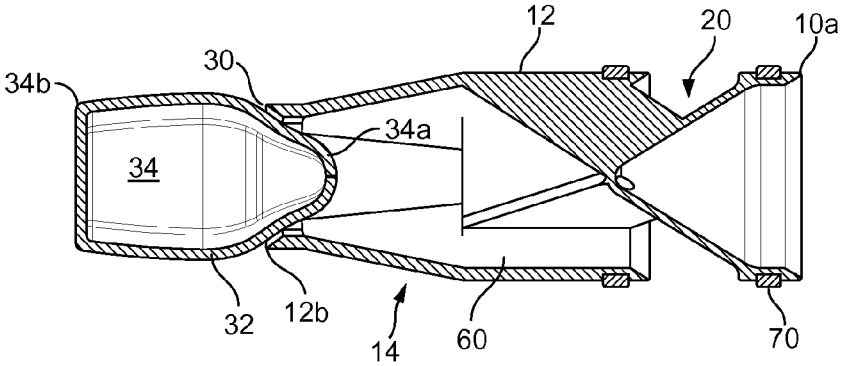
Figure 5D:
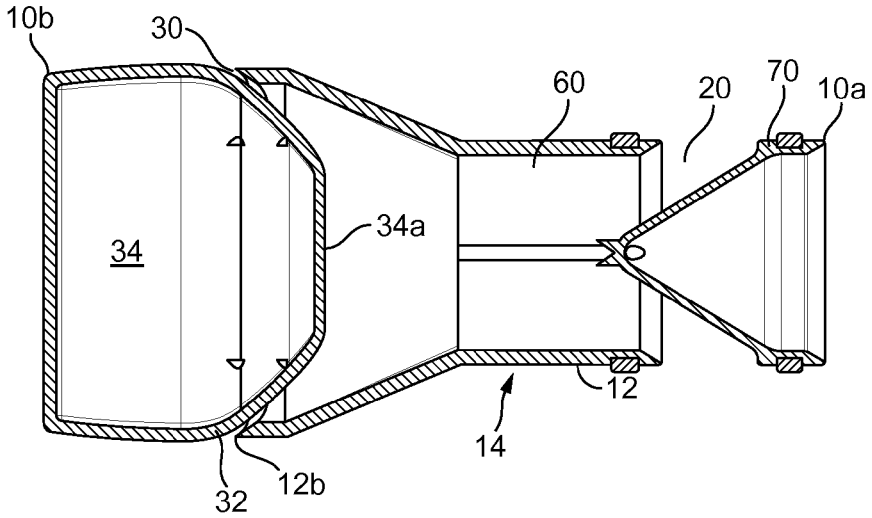
Figure 5E:
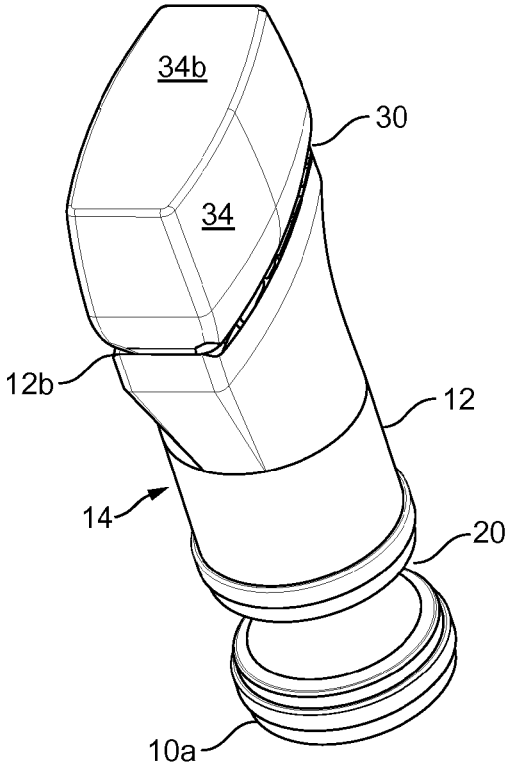

When the nozzle 600 is attached to a hairdryer 200 as shown in FIG. 4*a*, the fluid inlet 620 aligns with a primary fluid outlet 230 of the hairdryer. Hairdryer 200 has a second fluid flow path 280 through a central duct 282 but this is blocked by the nozzle 600. In the example shown in FIG. 2*a*, nozzle 100 blocked the second fluid flow path 280 at the upstream end 100*a* of the nozzle. In this example, the nozzle 600 uses an upstream continuation of curved wall 614*b* which curves inwards to form a rounded end 616 which blocks the second fluid flow path.

In order to seal the nozzle fluid flow path 660 with respect to the primary fluid outlet 230, the outer wall 612 of the nozzle is provided with a collar 612*a*. The collar 612*a* is upstanding from the outer wall 612 so has a larger diameter than the outer wall and is designed to fit with ducting 282 within the hairdryer 200. The collar 612*a* is upstream of the fluid inlet 620 of the nozzle 600. A second collar 612*b* is ideally also provided downstream of the fluid inlet 620 and prevents fluid from the primary outlet 230 of the hairdryer flowing between the outer wall 612 of the nozzle and the hairdryer outlet 200*b*.

FIGS. 5*a* to 5*e* show a further single flow path nozzle 10 which is similar to the one described with respect to FIG. 8. In this nozzle a fluid flow path 60 is provided from an inlet 20 to an outlet 30. The inlet 20 is through an outer wall 12 of a generally tubular body 14 of the nozzle 10 between a first or upstream end 10*a* and a second or downstream end 10*b* of the nozzle 10. The outlet 30 is a slit formed between the outer wall 12 and an inner wall 32 of the nozzle.

The inner wall 32 is convex and formed by a bung 34 which is located in the downstream end 12*b* of the outer wall 12. Fluid that flows through the fluid flow path 60 is funnelled by an upstream end 34*a* of the bung 34 towards the outlet 30. As the inner wall 32 is convex, fluid that flows out of the outlet 30 is drawn to the surface 32 by the Coanda effect and this entrains fluid 18 from the environment around the nozzle 10.

The shape of the bung 34 at the downstream end 34*b* is generally rectangular so the fluid exits the nozzle in a generally rectangular profile.

The rear or upstream end 10*a* of the nozzle has a cone shaped bung 70 so when the nozzle 10 is used in conjunction with hairdryer 200 (not shown), fluid from the second fluid flow path 280 is blocked by the cone shaped bung 70.

Figure 7A:
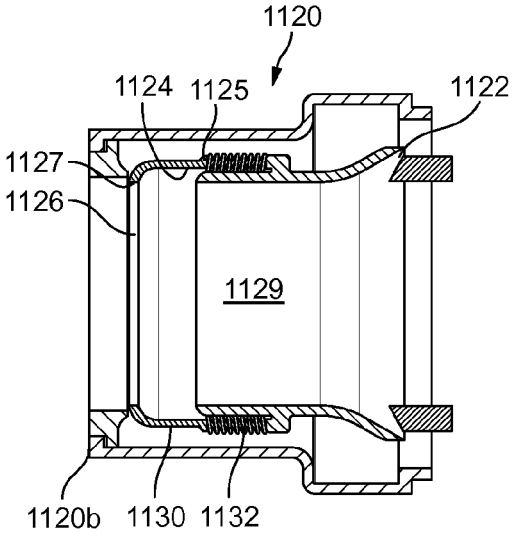
FIGS. 7*a* to 7*c* show a nozzle and hairdryer having two inlets into a single flow path.
Figure 7B:
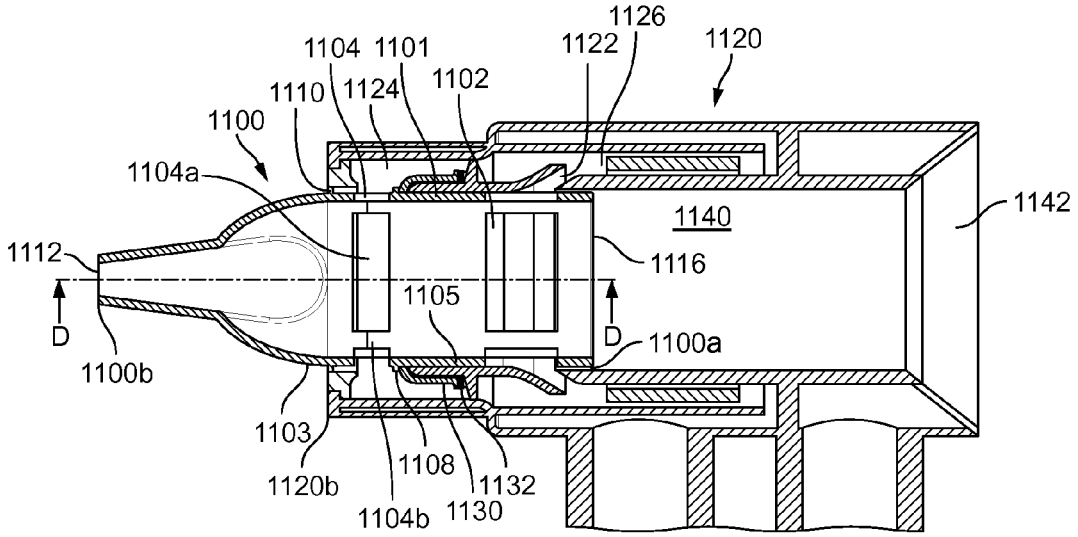
Figure 7C:
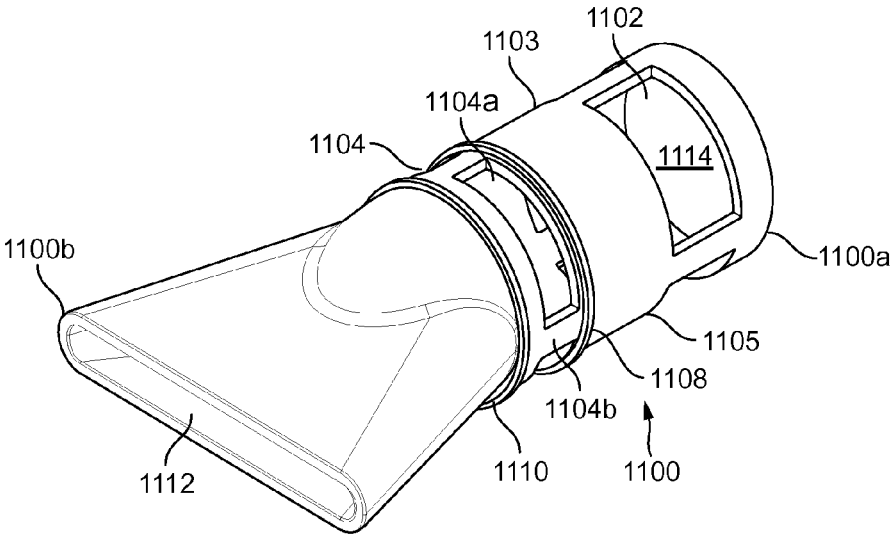

FIGS. 7*a* to 7*c* show a nozzle and hairdryer combination where the nozzle 1100 has a generally tubular body 1103 with a longitudinal axis D-D extending along the length of the body and having a first inlet 1102 and a second inlet 1104 into the fluid flow path 1106 of the nozzle 1100. The hairdryer 1120 has a corresponding primary outlet 1122 and second primary outlet 1124 which provide fluid communication with the first inlet 1102 and the second inlet 1104 respectively. This arrangement means that the primary flow through the primary fluid flow path 1126 of the hairdryer has two outlet regions. The use of a nozzle 1100 on a hairdryer 1120 introduces a restriction to the flow through the hairdryer resulting in a drop in output by the hairdryer of up to around 4 l/s. By introducing a second primary outlet 1124 for the primary flow the drop in output is mitigated.

The second inlet 1104 is similar to first inlet 1102 in that is extends in the direction of the longitudinal axis of the nozzle and radially round through outer wall 1110 of the generally tubular body 1103 of the nozzle 1100. The second inlet 1104 consists of a number of discrete apertures 1104*a* separated by reinforcing struts 1104*b*.

Referring to FIG. 7*a*, which shows a portion of a hairdryer having a primary fluid outlet comprising first 1122 and second 1124 primary outlets when there is no nozzle attached to the hairdryer 1120, the second primary outlet 1124 is closed as it is not required to increase flow through the primary fluid flow path 1126 of the hairdryer 1120. A closure 1130 is provided which occludes, blocks, covers or restricts the second primary outlet 1124. The closure 1130 is biased into the closed position by a spring 1132, in this example, which pushes against the closure 1124 to occlude the second primary outlet 1124. The first 1122 and second 1124 primary outlets both comprise apertures and are spaced apart along the longitudinal axis D-D of the nozzle 1100.

Referring now to FIG. 7*c*, the nozzle 1100 is provided with a lip 1108 which is upstanding from the generally tubular wall 1101 of the nozzle. The lip 1108 can be continuous or discontinuous around the perimeter of the generally tubular outer wall 1105 of the body 1103 of the nozzle 1100 and is of sufficient depth or height upstanding from the wall 1105 to firstly engage with the closure 1130 and secondly to allow the nozzle to be inserted up to the point of engagement of the lip 1108 with the closure 1130 without snagging of the nozzle 1100.

The lip in this example is formed from an O-ring which is held in a recess formed in the body 1103 of the nozzle. Alternatives will be apparent to the skilled person and include, but are not limited to an integral moulded lip, a plastic/hard rubber ring, a living hinge, an overmoulded lip and a push fit arrangement.

The closure 1130 is ring shaped and has an S-shaped profile. Central to the ring is an aperture 1126 to enable fluid flowing through the primary fluid flow path 1126 of the hairdryer to exit the downstream end 1120*b* of the hairdryer from the first primary fluid outlet 1122 of the hairdryer. A first end 1125 of the S-shaped profile of the closure 1130 engages with one end of spring 1132 and provides the means by which the closure 1130 is biased into an occluded or closed position. A second end 1127 of the S-shaped profile protrudes into the fluid flow path 1129 of the hairdryer between the primary outlet 1122 and the downstream end 1120*b* of the hairdryer. This second end 1127 of the closure 1130 engages with the lip 1108 of the nozzle 1100 when the nozzle is inserted far enough into the downstream end 1120*b* of the hairdryer 1120 (see FIG. 7*b*) and as the nozzle is inserted past the point of engagement, the closure 1130 is pushed against the action of the spring 1132 and slides, opening the second primary outlet 1124 to allow fluid flowing in the primary fluid flow path 1126 to exit via either the first primary outlet 1122 or the second primary outlet 1124 thus mitigating any restriction on fluid flow through the hairdryer from the use of a nozzle.

In order to prevent egress of fluid from the primary fluid flow path 1126 from the hairdryer outlet 1120*b* around the outside of the nozzle 1100. The outer wall 1103 is provided with an upstanding collar 1110 that extends about the outer wall 1103 and seals the nozzle with respect to the hairdryer outlet 1120. The collar 1110 additionally provides a point of friction between the nozzle and the hairdryer that retains the nozzle within the hairdryer.

The nozzle 1100 has a downstream end 110*b* where fluid is output through a nozzle outlet 1112 and an upstream end 1100*a*. In one embodiment the upstream end 1100*b* of the nozzle comprises an end wall 1114. In this embodiment, the primary flow from the hairdryer is the only flow that is output from the nozzle outlet 1112.

FIGS. 8*a* to 8*d* show a different arrangement. In this example, the second primary outlet 1174 from the primary fluid flow path 1176 is in an end wall 1160 of the hairdryer 1150 rather than through an internal wall.

Figure 8A:
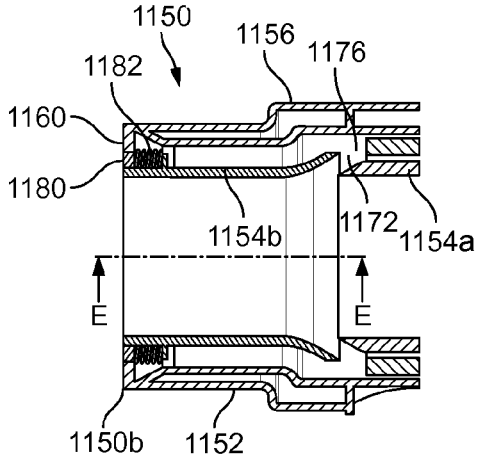
FIGS. 8*a* to 8*d* show an alternate two outlet arrangement.

Referring now to FIG. 8*a*, the hairdryer has a generally tubular body 1152 having an inner wall 1154*a* 1154*b* and an outer or external wall 1156. At the downstream end 1150*b* of the hairdryer an end wall 1160, 1180 is provided between the inner 1154*b* and outer 1156 wall. The end wall is orthogonal to a longitudinal axis E-E of the body 1152 and includes a fixed portion 1160 and a moveable portion or closure 1180. The closure 1180 is annular and is biased by a spring 1182 to be substantially flush with the fixed portion of the end wall 1160. When a nozzle is inserted into the hairdryer 1150, the closure 1180 is pushed against the spring 1182, causing the spring to compress and open the second primary outlet 1174. In this example, the closure 1180 is adjacent to the inner wall 1154*b* of the hairdryer however the closure could be located anywhere between the inner and outer walls. In addition, the closure need not be continuous around the end wall.

Figure 8B:
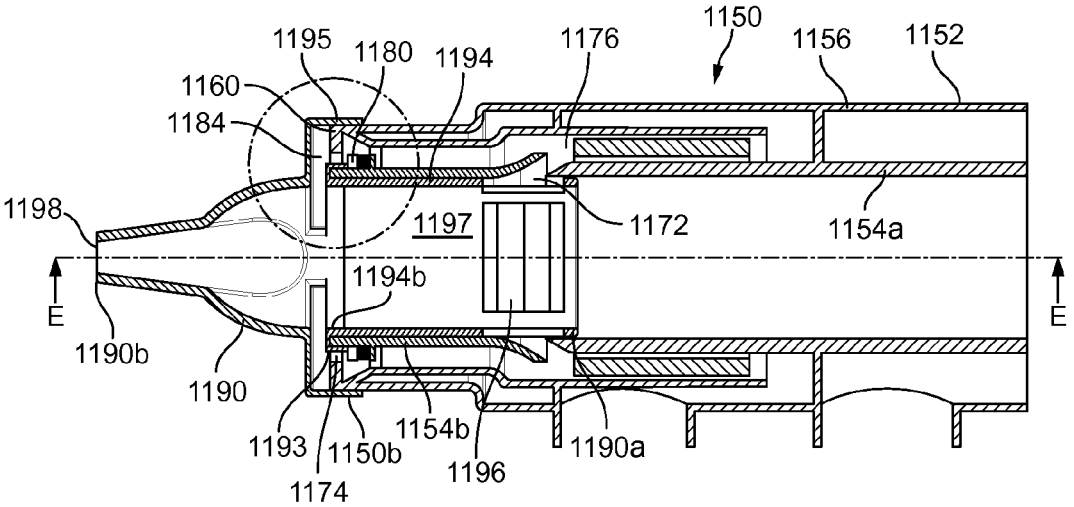
Figure 8C:
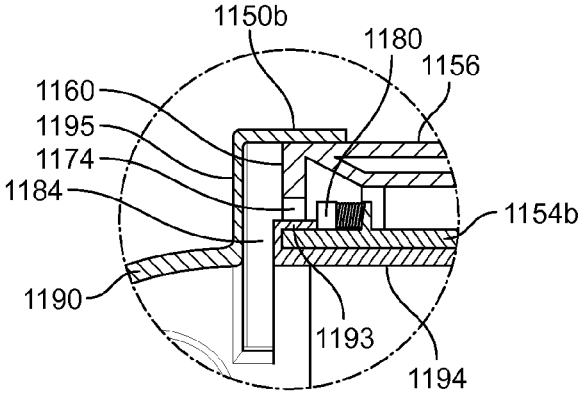
Figure 8D:
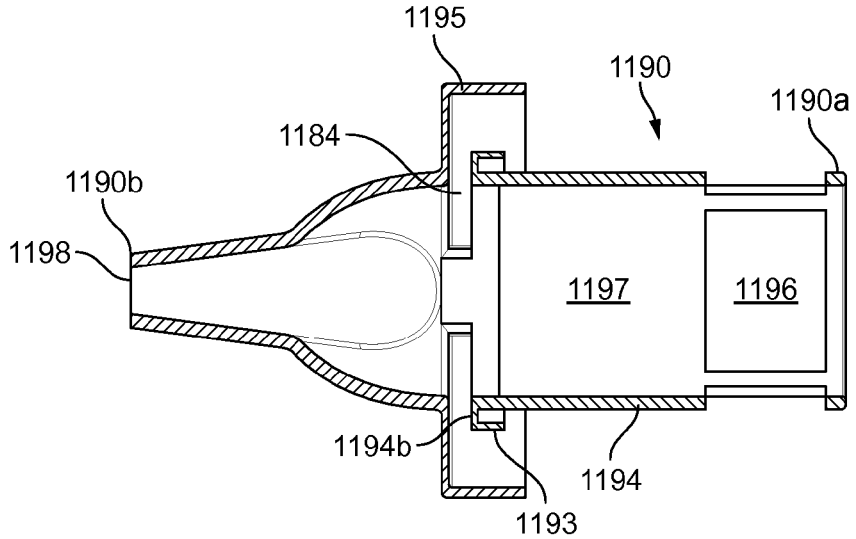

Referring now to FIG. 8*d*, the nozzle 1190 has a generally tubular body 1192 having an outer wall 1194. A first inlet 1196 is provided in the outer wall 1194 between an upstream or first end 1190*a* and a downstream or second end 1190*b* of the nozzle but towards the upstream end 1190*a* of the nozzle. This first inlet 1196 is in fluid communication with a first primary outlet 1172 of the hairdryer provided in the inner wall 1154 of the body of the hairdryer and a fluid flow path 1197 is provided through the nozzle from the first inlet 1196 through the body 1192 of the nozzle to a nozzle outlet 1198 at the downstream end 1190*b* of the nozzle. The outer wall 1194 of the nozzle is designed to be insertable into the outlet end 1150*b* of the hairdryer. At the downstream end 1194*b* of the outer wall 1194 a hook shaped lip 1193 is provided. When the nozzle 1190 is inserted in the hairdryer, the hooked shaped lip 1193 covers the end of inner wall 1154*b* of the hairdryer and engages with closure 1180 pushing it against the action of the spring 1182. In order to provide a second fluid flow path 1184 from the second opening 1174 to the downstream end 1190*b* of the nozzle, a collar 1195 is provided on the nozzle. When the nozzle is inserted into the hairdryer, the collar 1195 fits over the outer wall 1156 of the body 1152 of the hairdryer and forms together with the fixed portion of the end wall 1160 and the hook shaped lip 1193 a second fluid inlet 1184 for the nozzle which combines with fluid from the first inlet 1196 in the fluid flow path 1197 within the nozzle.

The nozzle 1190 is inserted as shown in FIGS. 8*b* and 8*c*; the lip 1193 engages with the closure 1180 and forces the closure back against the action of the spring 1182 opening the second primary outlet 1174.

FIGS. 9*a* to 9*d* show an alternate arrangement for mitigating flow restriction when a nozzle 1200 is used on a hairdryer 1252. In this example, insertion of a nozzle 1200 results in the primary fluid outlet 1250 of the hairdryer 1252 increasing in size.

The nozzle 1200 has a generally tubular body 1202 with a longitudinal axis F-F extending along the length of the body 1202. A fluid inlet 1208 comprising a number of apertures 1210 separated by struts 1212 has a length that extends in the direction of the longitudinal axis F-F of the nozzle 1200 and is located between a first or upstream end 1200*a* and a second or downstream end 1200*b* of the nozzle 1200 in an outer wall 1204 of the body 1202.

The hairdryer 1252 has a generally tubular body having an inner wall 1254*a*, 1254*b*, an outer wall 1256 and a primary fluid flow path 1258 provided therebetween. The primary fluid flow path 1258 flows from a primary inlet 1220 to a primary outlet 1250 provided as an aperture between two sections of the inner wall 1254*a*, 1254*b* and then through a central bore 1260 in the body of the hairdryer 1252 to a hairdryer outlet 1262.

Figure 9A:
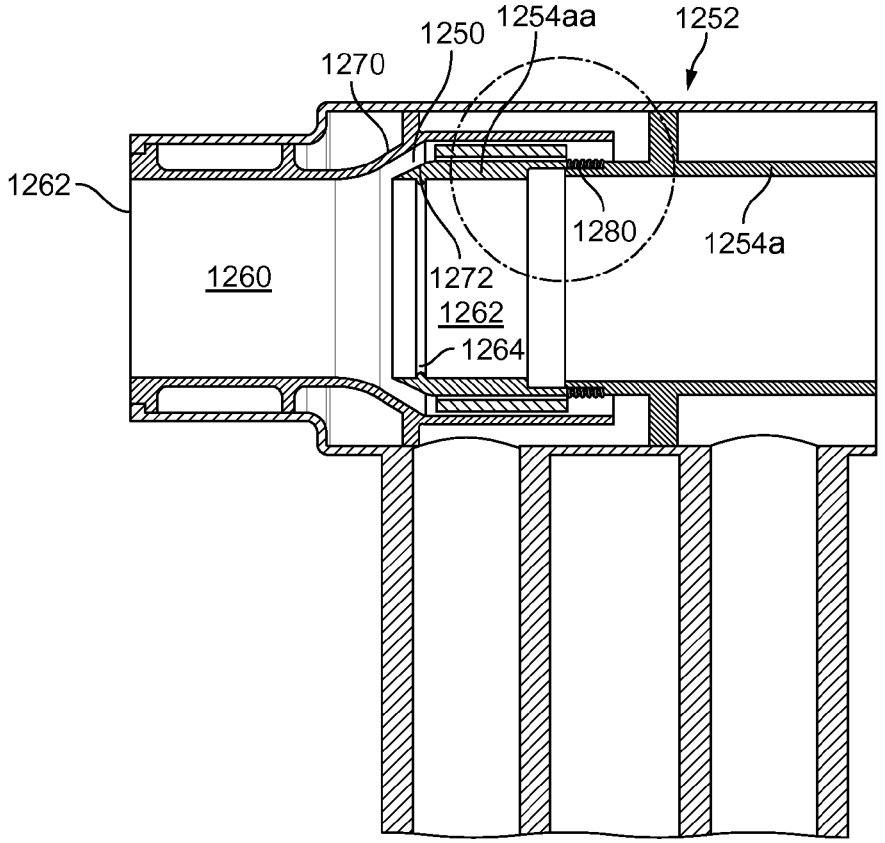
FIGS. 9*a* to 9*d* show a further nozzle and hairdryer combination.
Figure 9B:
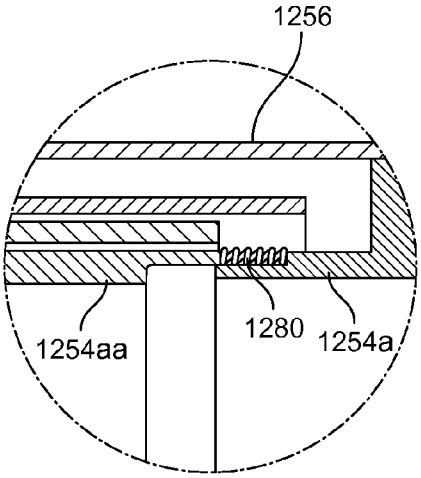
Figure 9C:
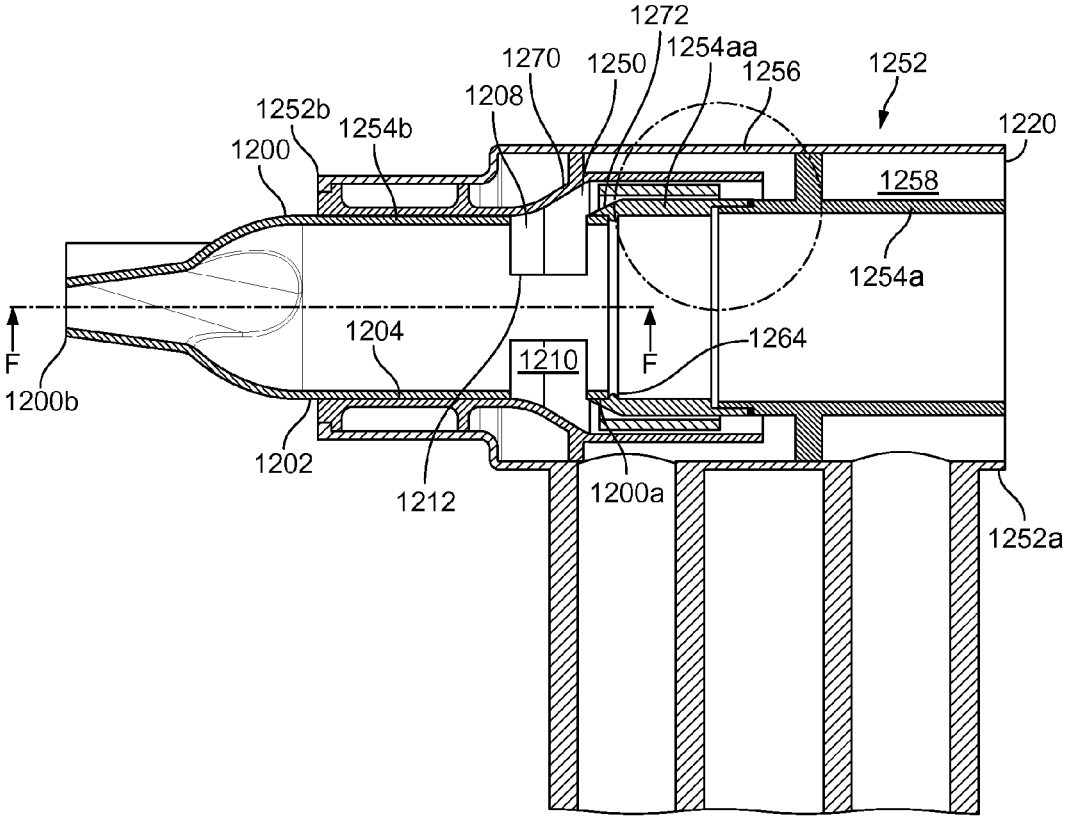
Figure 9D:
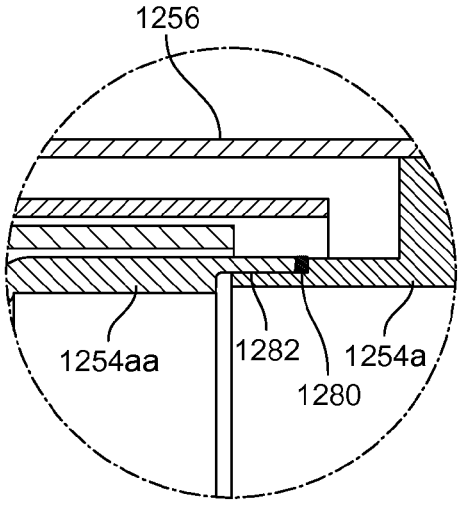

The primary outlet 1250 is formed from a fixed surface 1270 attached to the downstream section of inner wall 1254*b* and a moveable surface 1272 which is connected to an upstream section of the inner wall 1254*a*. In order that the primary outlet 1250 can be opened, a moveable portion 1254*aa* of the upstream inner wall 1254*a* is slidably moveable against the direction of fluid flow at the primary fluid outlet 1250 towards the upstream end 1252*a* of the hairdryer 1252. The upstream section of the inner wall 1254*a* and the moveable portion 1254*aa* form a lap joint 1282 (FIG. 14*d*) which is biased apart by a spring 1280 (FIGS. 9*a* and 9*b*). The moveable portion 1254*aa* has an internal surface which describes a duct 1262 within the hairdryer and is provided with a rim or lip 1264 which is upstanding from the duct 1262 and extends radially into the duct 1262. When a nozzle 1200 is inserted into the outlet 1262 of the hairdryer, the upstream end 1200*a* of the outer wall 1204 of the nozzle engages with the rim or lip 1262 on the moveable portion 1254*aa* and pushes the moveable portion 1254*aa* against the biasing action of the spring 1280 so the moveable portion 1254*aa* slides towards the upstream inner wall 1254*a* and opens the primary fluid outlet 1250 (FIGS. 9*c* and 9*d*).

When the nozzle 1200 is subsequently removed, the moveable portion 1254*aa* slides back towards the downstream end 1252*b* of the hairdryer 1252 causing the primary outlet 1250 to reduce back to its' original size.

FIGS. 10*a*, 10*b*, 10*h* to 10*k* all show a hairdryer 670 having a primary fluid flow path 671 which is processed by a fan unit 672 and a heater 673 second fluid flow path 680 which comprises fluid that has been entrained into the hairdryer by the action of the fan unit 672 drawing fluid into the primary fluid flow path 671.

Figure 10A:
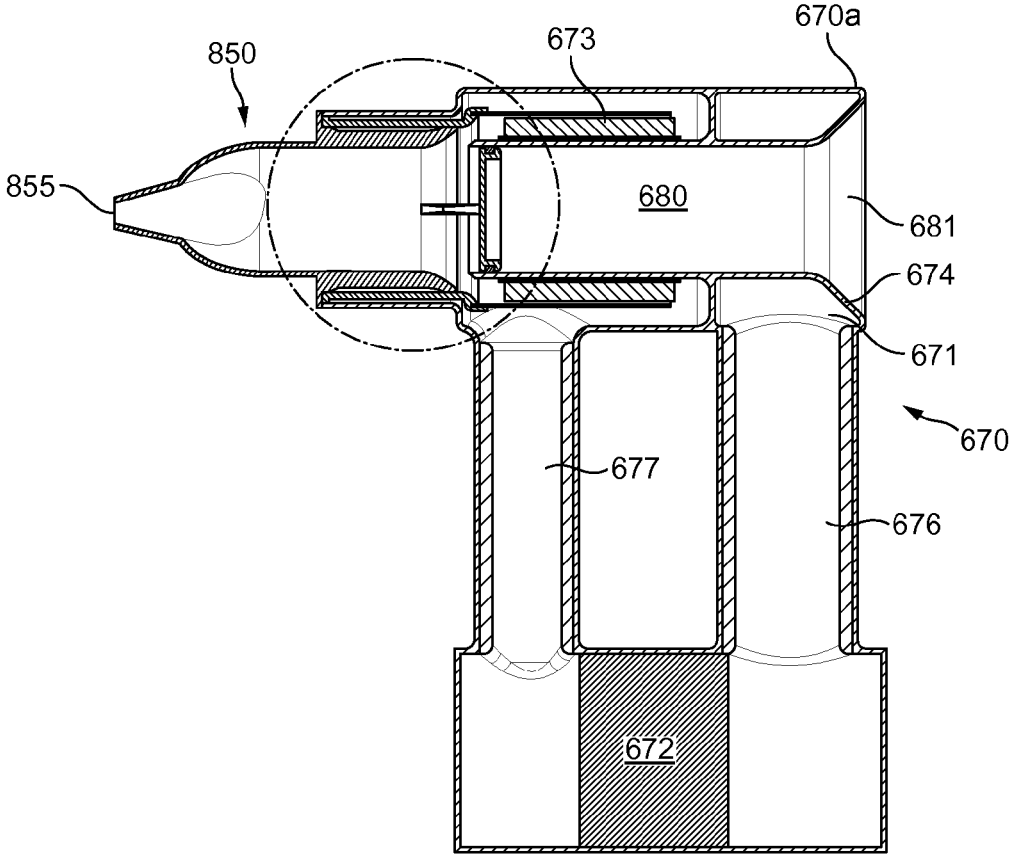
FIGS. 10*a* to 10*g* show yet another single flow path nozzle and hairdryer.
Figure 10B:
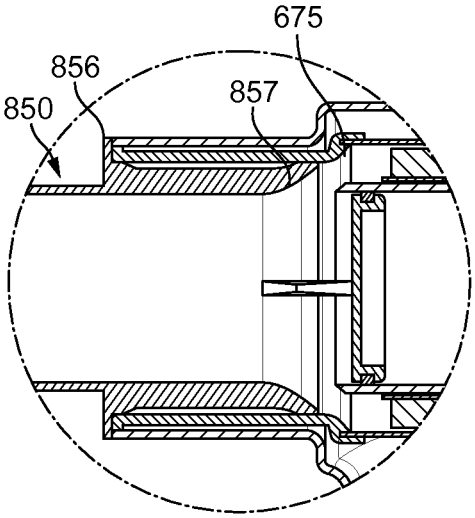
Figure 10C:
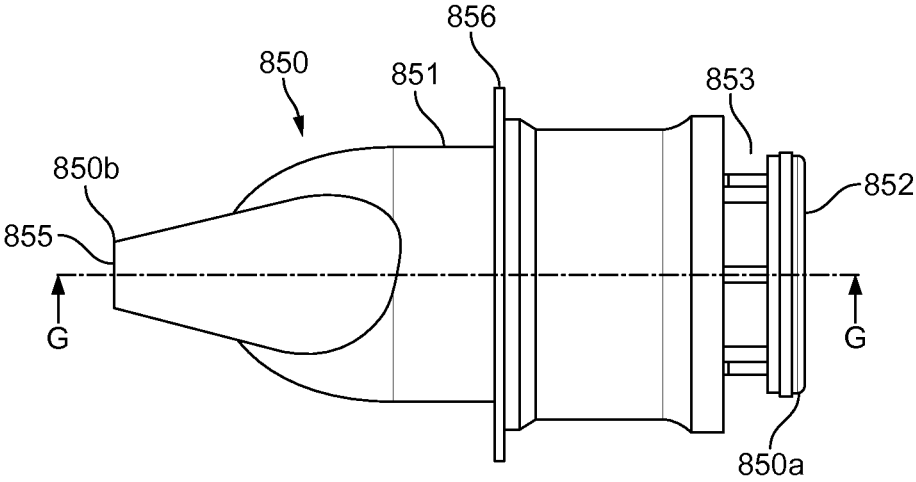
Figure 10D:
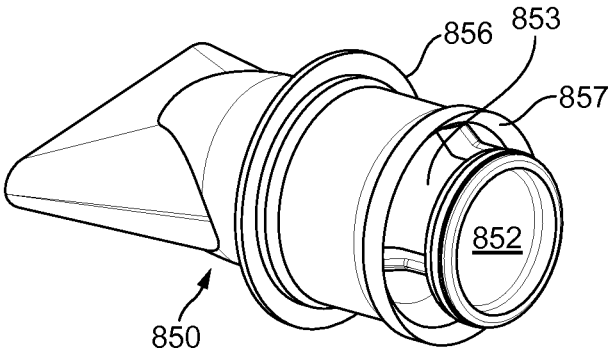
Figure 10E:
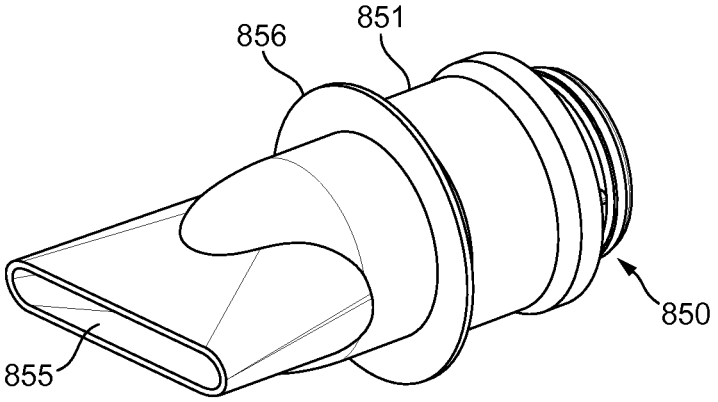
Figure 10F:
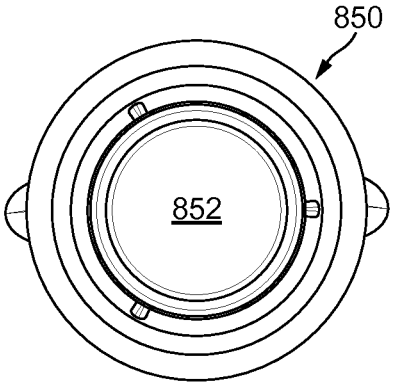
Figure 10G:
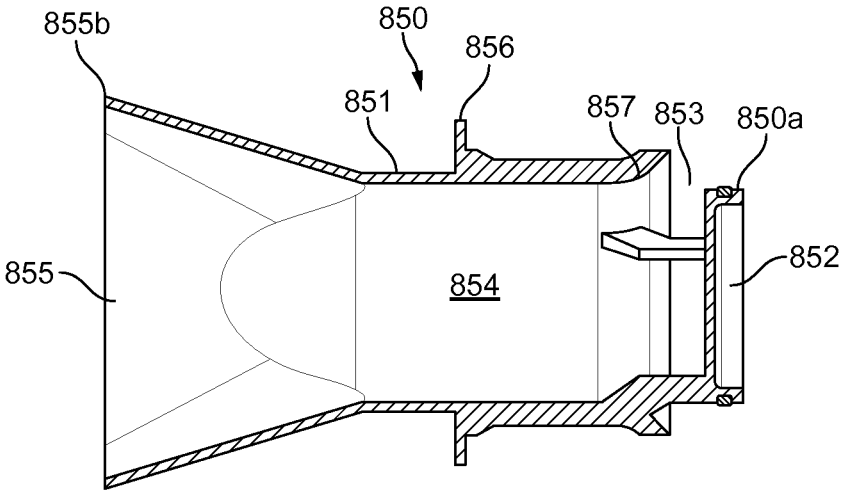
Figure 10H:
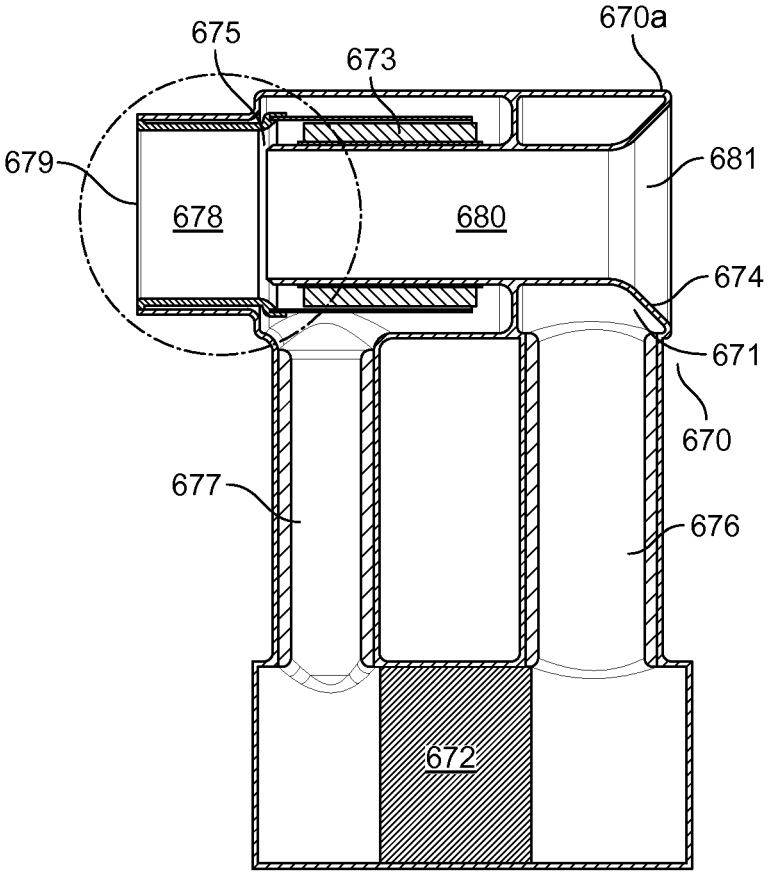
FIGS. 10*h* and 10*i* show the hairdryer without a nozzle.
Figure 10I:
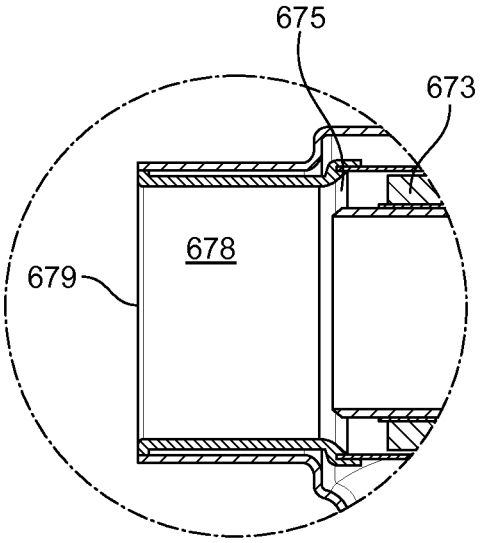
Figure 10J:
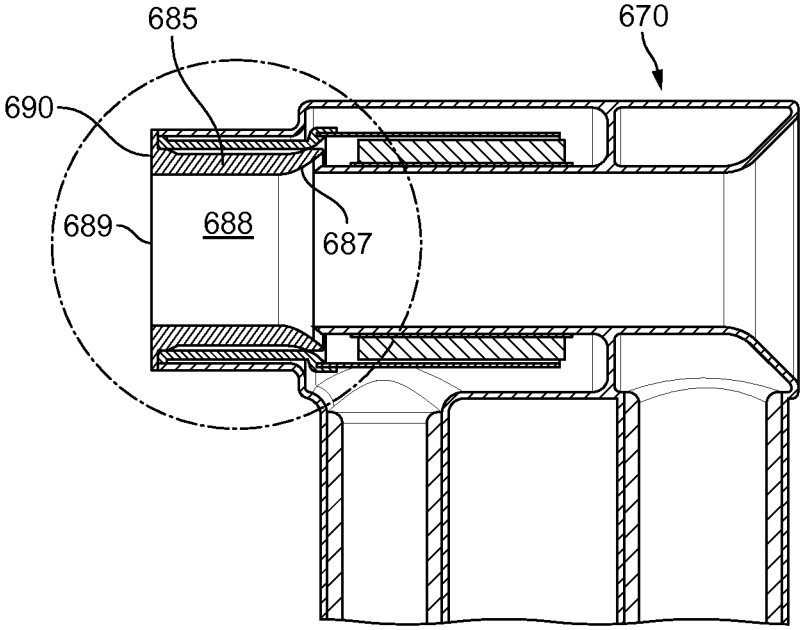
FIGS. 10*j* to 10*m* show a further attachment with a hairdryer.
Figure 10K:
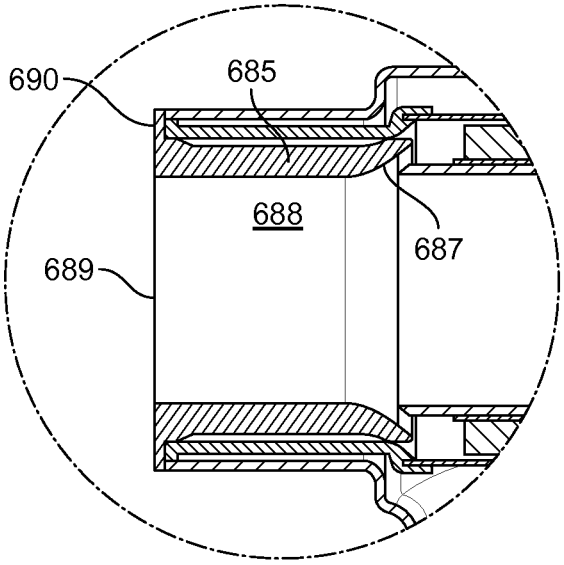

Referring in particular to FIGS. 10*h* and 10*i*, a primary fluid flow is drawn into the primary fluid flow path 671 at a primary inlet 674 and flows along a first handle 676 though a fan unit 672, along a second handle 677 through a heater 673 and out of a primary outlet 675 into a duct 678 of the hairdryer to the fluid outlet 679. A second fluid flow path 680 is provided from a second inlet 681 at the upstream end 670*a* of the hairdryer through the duct 678 to the hairdryer outlet 679. Fluid is entrained into the second fluid flow path 680 by the action of the fan unit 672 drawing fluid into the primary inlet 674 to the primary outlet 675 and mixes or combines with the primary flow at the primary fluid outlet 675. The fluid that flows through the duct 678 to the outlet 679 is a combined primary and entrained flow.

Figure 10L:
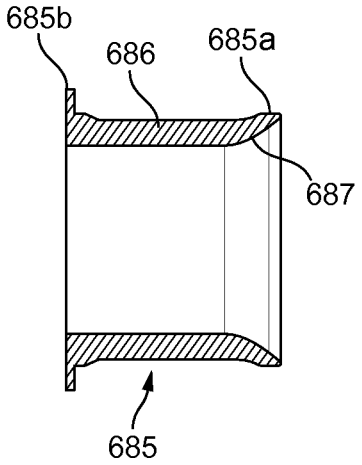
Figure 10M:
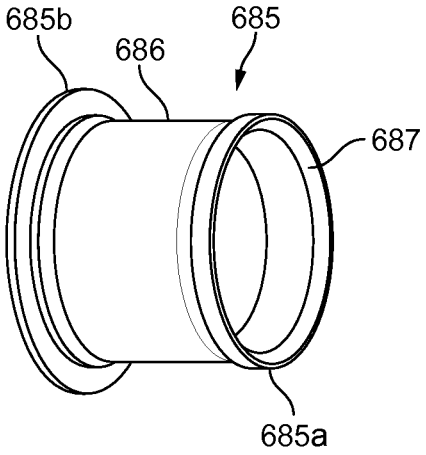

The primary fluid outlet 675 is relatively large and unrestricted. In order to encourage entrainment into the second fluid flow path 680, an attachment 685 is provided. The attachment 685 (FIGS. 10*l* and 10*m*) is inserted into the hairdryer outlet 679 and comprises a generally tubular body 686 between a first or upstream end 685*a* and a second or downstream end 685*b*. In order to encourage entrainment by the Coanda effect, the attachment 685 is provided with a Coanda surface 687 at the upstream end 685*a*. The Coanda surface 687 is in fluid communication with the primary fluid outlet 675 when the attachment is inserted in the hairdryer 670 (FIGS. 10*j* and 10*k*) and causes primary fluid to hug the Coanda surface 687 when the primary fluid flow exits the primary fluid outlet 675 into the nozzle fluid flow path 688 and to a nozzle outlet 689. The downstream end 685*b* of the attachment 685 is provided with an upstanding lip 690 which protrudes from the downstream end 670*b* of the hairdryer and covers the downstream end 670*b* of the hairdryer. The nozzle outlet 689 is circular and has a smaller diameter than the hairdryer outlet 679.

Referring now to FIGS. 10*c* to 10*g*, a second attachment 850 is provided. This second attachment 850 is a hot styling nozzle and only provides an outlet for the primary flow from the hairdryer 670.

The second attachment 850 has a generally tubular body 851 which defines a longitudinal axis G-G of the attachment from a first or upstream end 850*a* to a second or downstream end 850*b*. At the upstream end 850*a*, an end wall 852 is provided which is designed to block the second fluid flow path 680 of the hairdryer 670. A fluid inlet 853 is provided in the body 851 downstream of the end wall 852 and fluid can flow from the fluid inlet 853 along a fluid flow path 854 to a fluid outlet 855 at the downstream end 850*b* of the nozzle. The nozzle 850 is designed to be partially insertable into hairdryer 670 such that the fluid inlet is in fluid communication with the primary fluid outlet 675. The portion of the nozzle that is insertable is generally tubular and is provided with an upstanding lip of collar 856 around the body 850 which abuts the downstream end 670*b* of the hairdryer when the attachment 850 is inserted properly. Downstream of the lip 856, the change of the attachment changes from generally circular to generally rectangular to provide a focused flow from the nozzle outlet 855.

When there is no nozzle of the first type of nozzle 685 attached to the hairdryer 670, a primary fluid flow is augmented by an entrained flow through the second fluid flow path 680 and the total fluid output from the fluid outlet 679 is the combined value of the primary flow and the entrained flow. The second attachment 850 only allows primary flow from the hairdryer and blocks the entrained flow so, could suffer from a lower velocity of fluid output at the nozzle outlet 855. However, this is mitigated as the upstream end 855*a* of the nozzle 855 is designed to sit in the duct 678 of the hairdryer 670 so it does not restrict flow from the primary outlet 675. The upstream end of the nozzle body 851 has a curved wall 857 so turbulence and pressure losses as a result of the use of the second attachment 850 are minimised. This second nozzle 850 has the effect of opening up the amp gap or the primary fluid outlet 675.

The lip or collar 856, 690 has the effect of not only informing the user that the nozzle or attachment 850, 685 has been correctly inserted into the hairdryer outlet 679 but also provides a seal against fluid from the primary fluid outlet 675 exiting external to the nozzle or attachment 850, 685.

The nozzle is retained with respect to the hairdryer by one of a number of alternatives which include but are not limited to a felt seal, a bump stop, an O-ring, magnets, friction fit, a mechanical clip, snap fit or actuated snap fit.

The hairdryers are preferably provided with a filter 222 (FIGS. 2*b* and 2*c*) which covers at least the primary fluid flow inlet 220 of the hairdryer. The filter 222 is provided as is prevents ingress of dust, debris and hair into the primary fluid flow path upstream 260 of the fan unit 250 which includes a fan and a motor. These foreign objects could damage the motor and cause premature failure of the hairdryer. The filter 222 can cover the entire intake of the hairdryer i.e. both the primary fluid flow path 260 and the second fluid flow path 280 however this is not preferred as it interferes with a line of sight through the appliance. A line of sight through the appliance is restricted by the use of a nozzle on the appliance.

The invention has been described in detail with respect to a nozzle for a hairdryer and a hairdryer comprising a nozzle however, it is applicable to any appliance that draws in a fluid and directs the outflow of that fluid from the appliance.

The appliance can be used with or without a heater; the action of the outflow of fluid at high velocity has a drying effect.

The fluid that flows through the appliance is generally air, but may be a different combination of gases or gas and can include additives to improve performance of the appliance or the impact the appliance has on an object the output is directed at for example, hair and the styling of that hair.

The invention is not limited to the detailed description given above. Variations will be apparent to the person skilled in the art.

The invention claimed is:

1. A hairdryer comprising a handle; a body comprising a fluid outlet and a primary fluid outlet; a fan unit for generating fluid flow through the hairdryer, the hairdryer comprising a fluid flow path extending from a fluid inlet through which a fluid flow enters the hairdryer to the fluid outlet, and a primary fluid flow path extending from a primary fluid inlet through which a primary fluid flow enters the hairdryer to the primary fluid outlet, wherein the primary fluid flow path is separate from the fluid flow path; a heater for heating the primary fluid flow drawn through the primary fluid inlet; and a nozzle attachable to the body, the nozzle comprising a nozzle fluid inlet for receiving the primary fluid flow from the primary fluid outlet, and a nozzle fluid outlet for emitting the primary fluid flow, and wherein the nozzle is configured to at least partially block the emission of the fluid flow from the fluid outlet.

2. The hairdryer of claim 1, wherein the nozzle is configured to inhibit the generation of the fluid flow.

3. The hairdryer of claim 1, wherein the nozzle comprises a device for inhibiting the flow of fluid along the fluid flow path to the fluid outlet.

4. The hairdryer of claim 3, wherein the device for inhibiting the flow of fluid along the flow path to the fluid outlet comprises a barrier which is located within the fluid flow path when the nozzle is attached to the hairdryer.

5. The hairdryer of claim 4, wherein the barrier is located at an end of the nozzle.

6. The hairdryer of claim 4, wherein the barrier is substantially orthogonal to the longitudinal axis of the nozzle.

7. The hairdryer of claim 4, wherein the barrier is inclined to the longitudinal axis of the nozzle.

8. The hairdryer of claim 1, wherein the primary fluid outlet is configured to emit the primary fluid flow into the fluid flow path, and wherein the nozzle comprises a first end which is insertable into the fluid flow path through the fluid outlet, and a second end remote from the first end, and wherein the nozzle fluid inlet is located between the first end and the second end of the nozzle.

9. The hairdryer of claim 8, wherein the nozzle fluid inlet comprises at least one aperture extending at least partially about the longitudinal axis of the nozzle.

10. The hairdryer of claim 8, wherein the nozzle fluid inlet comprises a plurality of apertures extending circumferentially about the longitudinal axis of the nozzle.

11. The hairdryer of claim 9, wherein the at least one aperture has a length extending in the direction of the longitudinal axis of the nozzle, and wherein the length of said at least one aperture varies about the longitudinal axis of the nozzle.

12. The hairdryer of claim 8, wherein the nozzle comprises a side wall between the first end and the second end of the nozzle, and wherein a portion of the side wall which is located between the first end and the second end of the nozzle at least partially defines the nozzle fluid inlet.

13. The hairdryer of claim 12, wherein the side wall is tubular in shape.

14. The hairdryer of claim 12, wherein the nozzle fluid inlet is formed in the side wall.

15. The hairdryer of claim 12, wherein the side wall extends about an inner wall, and wherein the nozzle fluid inlet is located between the walls of the nozzle.

16. The hairdryer of claim 15, wherein the inner wall is tubular in shape.

17. The hairdryer of claim 15, wherein the inner wall extends from the first end to the second end.

18. The hairdryer of claim 8, wherein the second end of the nozzle comprises the nozzle fluid outlet.

19. The hairdryer of claim 8, wherein the nozzle fluid outlet is located between the first end and the second end of the nozzle.

20. A nozzle for a hairdryer comprising a handle; a body comprising a fluid outlet and a primary fluid outlet; a fan unit for generating fluid flow through the hairdryer, a fluid flow path extending from a fluid inlet through which a fluid flow enters the hairdryer to the fluid outlet, and a primary fluid flow path extending from a primary fluid inlet through which a primary fluid flow enters the hairdryer to the primary fluid outlet, wherein the primary fluid flow path is separate from the fluid flow path; and a heater for heating the primary fluid flow drawn through the primary fluid inlet;

wherein the nozzle is attachable to the body, the nozzle comprising a nozzle fluid inlet for receiving the primary fluid flow from the primary fluid outlet, and a nozzle fluid outlet for emitting the primary fluid flow, and wherein the nozzle is configured to at least partially block the emission of the fluid flow from the fluid outlet.

* * * * *